US010310418B2

(12) United States Patent
Torikata et al.

(10) Patent No.: US 10,310,418 B2
(45) Date of Patent: Jun. 4, 2019

(54) SEPARATING DEVICE

(71) Applicant: CANON KABUSHIKI KAISHA, Tokyo (JP)

(72) Inventors: Kotaro Torikata, Chigasaki (JP); Teppei Nagata, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/558,299

(22) PCT Filed: May 27, 2016

(86) PCT No.: PCT/JP2016/066515

§ 371 (c)(1),
(2) Date: Sep. 14, 2017

(87) PCT Pub. No.: WO2016/190449

PCT Pub. Date: Dec. 1, 2016

(65) Prior Publication Data

US 2018/0059581 A1 Mar. 1, 2018

(30) Foreign Application Priority Data

May 27, 2015 (JP) ..... 2015-107895
May 27, 2015 (JP) ..... 2015-107896
May 2, 2016 (JP) ..... 2016-092779

(51) Int. Cl.
*G03G 15/10* (2006.01)
*G03G 9/12* (2006.01)
(Continued)

(52) U.S. Cl.
CPC ..... *G03G 15/104* (2013.01); *G03G 9/12* (2013.01); *G03G 15/0815* (2013.01); *G03G 15/10* (2013.01); *G03G 15/1605* (2013.01)

(58) Field of Classification Search
CPC ..... G03G 9/12; G03G 15/081; G03G 15/104; G03G 15/0815; G03G 15/1605
See application file for complete search history.

(56) References Cited

U.S. PATENT DOCUMENTS 4,985,732 A 1/1991 Landa et al.
5,933,685 A 8/1999 Yoo
(Continued)

FOREIGN PATENT DOCUMENTS

JP H04-504010 A 7/1992
JP H05-072907 A 3/1993
(Continued)

OTHER PUBLICATIONS

Notification of Transmittal of the International Search Report and the Written Opinion dated Aug. 23, 2016, in International Application No. PCT/JP2016/066515.
(Continued)

*Primary Examiner* — Hoang X Ngo
(74) *Attorney, Agent, or Firm* — Venable LLP

(57) ABSTRACT

A separating device includes an electrode roller, an electrode member, a liquid developer supplying portion, a carrier liquid collecting portion, a collecting roller and a blade member. When a line passing through a center and a top of the electrode roller with respect to a gravitational direction is 0°, an upstream end portion of a gap between the electrode roller and the electrode member is positioned in a range of 0° or more and less than 180° with respect to an electrode roller rotational direction. When a line passing through a center and a top of the collecting roller with respect to the gravitational direction is 0°, a contact position of the blade member with the collecting roller is in a range of 35° or more in an upstream side of a contact position between the collecting and electrode rollers with respect to a collecting roller rotational direction.

21 Claims, 13 Drawing Sheets

(51) Int. Cl.
*G03G 15/08* (2006.01)
*G03G 15/16* (2006.01)

(56) References Cited

U.S. PATENT DOCUMENTS

| | | | | |
|---|---|---|---|---|
| 7,844,204 | B2 * | 11/2010 | Oda | G03G 15/104 399/249 |
| 7,890,012 | B2 | 2/2011 | Koishi et al. | |
| 8,509,656 | B2 | 8/2013 | Kopp | |
| 8,526,841 | B2 | 9/2013 | Koishi et al. | |
| 8,862,015 | B2 | 10/2014 | Koishi et al. | |
| 2008/0181671 | A1 * | 7/2008 | Oda | G03G 15/104 399/241 |
| 2012/0213542 | A1 | 8/2012 | Tsukada et al. | |

FOREIGN PATENT DOCUMENTS

| | | | |
|---|---|---|---|
| JP | H08-179632 | A | 7/1996 |
| JP | 09-022238 | A | 1/1997 |
| JP | 11-052740 | A | 2/1999 |
| JP | 2003-270957 | A | 9/2003 |
| JP | 3875577 | B2 | 1/2007 |
| JP | 2008-242433 | A | 10/2008 |
| JP | 2008-242434 | A | 10/2008 |
| JP | 2008-242436 | A | 10/2008 |
| JP | 4659485 | B2 | 3/2011 |
| JP | 50555147 | B2 | 10/2012 |
| JP | 2012-230187 | A | 11/2012 |
| JP | 5495714 | B2 | 5/2014 |
| JP | 5679802 | B2 | 3/2015 |
| RU | 2488869 | C1 | 7/2013 |

OTHER PUBLICATIONS

Teppei Nagata et al., U.S. Appl. No. 15/556,683, filed Sep. 8, 2017.
Teppei Nagata et al., U.S. Appl. No. 15/556,348, filed Sep. 7, 2017.
Russian Notice of Allowance dated Jul. 3, 2018 in related Russian Patent Application No. 2017135440/28 (with English translation).
English translation of Korean Office Action dated Nov. 1, 2018, in related Korean Patent Application No. 10-2017-7036377.
Korean Office Action dated Nov. 1, 2018, in related Korean Patent Application No. 10-2017-7036377.
European Search Report dated Jan. 8, 2019, in related European Patent Application No. 16800153.5.

* cited by examiner

SEPARATING DEVICE

TECHNICAL FIELD

The present invention relates to a separating device for separating a toner and a carrier liquid from a liquid developer, and an image forming apparatus, including the separating device, for forming an image with the liquid developer.

BACKGROUND ART

Conventionally, the image forming apparatus for forming the image with the liquid developer containing the toner and the liquid developer has been known. In the image forming apparatus, the liquid developer which is not used in an image forming step is collected and recycled. In such a recycling process of the liquid developer, toner particles which are a dispersoid in the liquid developer (liquid material) and the carrier liquid which is a dispersion medium in the liquid developer are separated, and then the carrier liquid is used again.

For example, a constitution in which an electrode roller, a damming roller, a blade member and a liquid accommodating container are provided has been proposed (Japanese Laid-Open Patent Application (JP-A) 2008-242436). In the constitution described in JP-A 2008-242436, as shown in (a) of FIG. 15, the liquid developer is supplied between an electrode roller 942 and a liquid accommodating container 941. Then, the electrode roller 942 is rotated while applying a voltage to between the electrode roller 942 and the liquid accommodating container 941 so that the toner is attracted toward the electrode roller 942. Here, a supply port 946*a* through which the liquid developer is supplied is positioned with respect to a substantially horizontal direction, and the liquid developer passed through between the electrode roller 942 and the liquid accommodating container 941 is discharged through a discharge port 946*b* positioned above the supply port 946*a* with respect to a direction of gravitation and then is sent to a carrier tank (not shown).

In a side of the electrode roller 942, downstream of the discharge port 946*b* with respect to a rotational direction of the electrode roller 942, the damming roller 943 is disposed in contact with the electrode roller 942, so that the liquid developer fed (conveyed) by the electrode roller 942 is dammed by the damming roller 943. At a position further downstream of the damming roller 943, a blade member 944 is disposed in contact with the electrode roller 942 and solid components of the liquid developer, fed with rotation of the electrode roller 942 without being dammed by the damming roller 943, off a surface of the electrode roller 942.

Incidentally, between the supply port 946*a* and the discharge port 946*b*, another discharge port 946*c* for circulating the liquid developer between itself and the supply port 946*a* is provided. The liquid developer is circulated between another discharge port 946*c* and the supply port 946*a* until a toner content (concentration) in the carrier liquid is not more than a predetermined value, and then is discharged through the discharge port 946*b*.

In the case of the constitution described in JP-A 2008-242436, as shown in (b) of FIG. 15, during passing of the liquid developer through between the liquid accommodating container 941 and the electrode roller 942, on the surface of the electrode roller 942, an urged toner T layer and a carrier liquid C layer outside the toner T layer are formed. The toner T layer and the carrier liquid C layer which are fed with rotation of the electrode roller 942 pass through between the electrode roller 942 and the damming roller 943. At this time, the carrier liquid C layer is divided into a portion on the damming roller 943 side and a portion on the electrode roller 942 side in a predetermined proportion.

Here, the carrier liquid C layer separated and fed on the damming roller 943 side is carried on the damming roller 943, and the toner T layer passed through between the electrode roller 942 and the damming roller 943 is collected by a blade member 944.

In order to enhance reuse efficiency of the carrier liquid, it would be considered that a position where the developer is supplied to the damming roller 943 is disposed in a region (from 0 o'clock position to 6 o'clock position) in which the surface of the electrode roller moves from above toward below. In this case, in the case where a constitution in which the toner on the electrode roller is directly scraped off is employed, a contact position of a blade is in the 6 o'clock position or the later. In general, the blade is provided in contact with the electrode roller in a direction counter to a rotational direction of the electrode roller in order to improve a collecting property. For this reason, the toner collected by the blade flows back onto the electrode roller along the blade in some cases. Further, the contact position of the blade is restricted, and therefore an inclination angle of the blade with respect to a horizontal direction becomes small. As a result, the toner stagnates on the blade, so that there was a liability that a toner collecting property lowers.

SUMMARY OF THE INVENTION

The present invention has been accomplished in view of the above-described circumstances and a principal object of the present invention is to improve a separation property between a carrier liquid and a toner.

According to an aspect of the present invention, there is provided separating device for separating a toner and a carrier liquid from a liquid developer including the toner and the carrier liquid using an electric field, the separating device comprising: an electroconductive electrode roller rotatable in a predetermined direction; an electrode member provided with a gap between itself and an outer peripheral surface of the electrode roller, wherein the electrode member is capable of applying a voltage for generating an electric field for moving the toner toward the electrode roller between the electrode roller and the electrode member, wherein an upstream end portion of the gap with respect to a rotational direction of the electrode roller is provided above, with respect to a direction of gravitation, a downstream end portion of the gap with respect to the rotational direction; a supplying portion configured to supply the liquid developer into the gap from the upstream end portion of the gap; a collecting portion provided below the upstream end portion of the gap with respect to the direction of gravitation and configured to collect the carrier liquid from the electrode roller in a side downstream of the electrode member with respect to the rotational direction; a collecting roller provided downstream of the electrode member with respect to the rotational direction and rotatable in the same peripheral movement direction as the electrode roller in contact with the electrode roller at a position opposing the electrode roller, wherein the collecting roller is capable of applying a voltage for generating an electric field for moving the toner toward the collecting roller between the collecting roller and the electrode roller; and a blade member configured to collect the toner from the collecting roller in contact with the collecting roller counterdirectionally with respect to a rotational direction of the collecting roller, wherein when a line passing through a center of the electrode roller and a top of the electrode roller with respect to the direction of gravitation is 0°, the upstream end portion of the gap is positioned in a range of 0° or more and less than 180° with respect to the rotational direction of the electrode roller, and wherein when a line passing through a center of the collecting roller and a top of the collecting roller with respect to the direction of gravitation is 0°, a contact position of the blade member with the collecting roller is in a range of 35° or more in a side upstream of a position of contact between the collecting roller and the electrode roller with respect to the rotational direction of the collecting roller.

Further features of the present invention will become apparent from the following description of exemplary embodiments with reference to the attached drawings.

DESCRIPTION OF EMBODIMENTS

Figure 1:
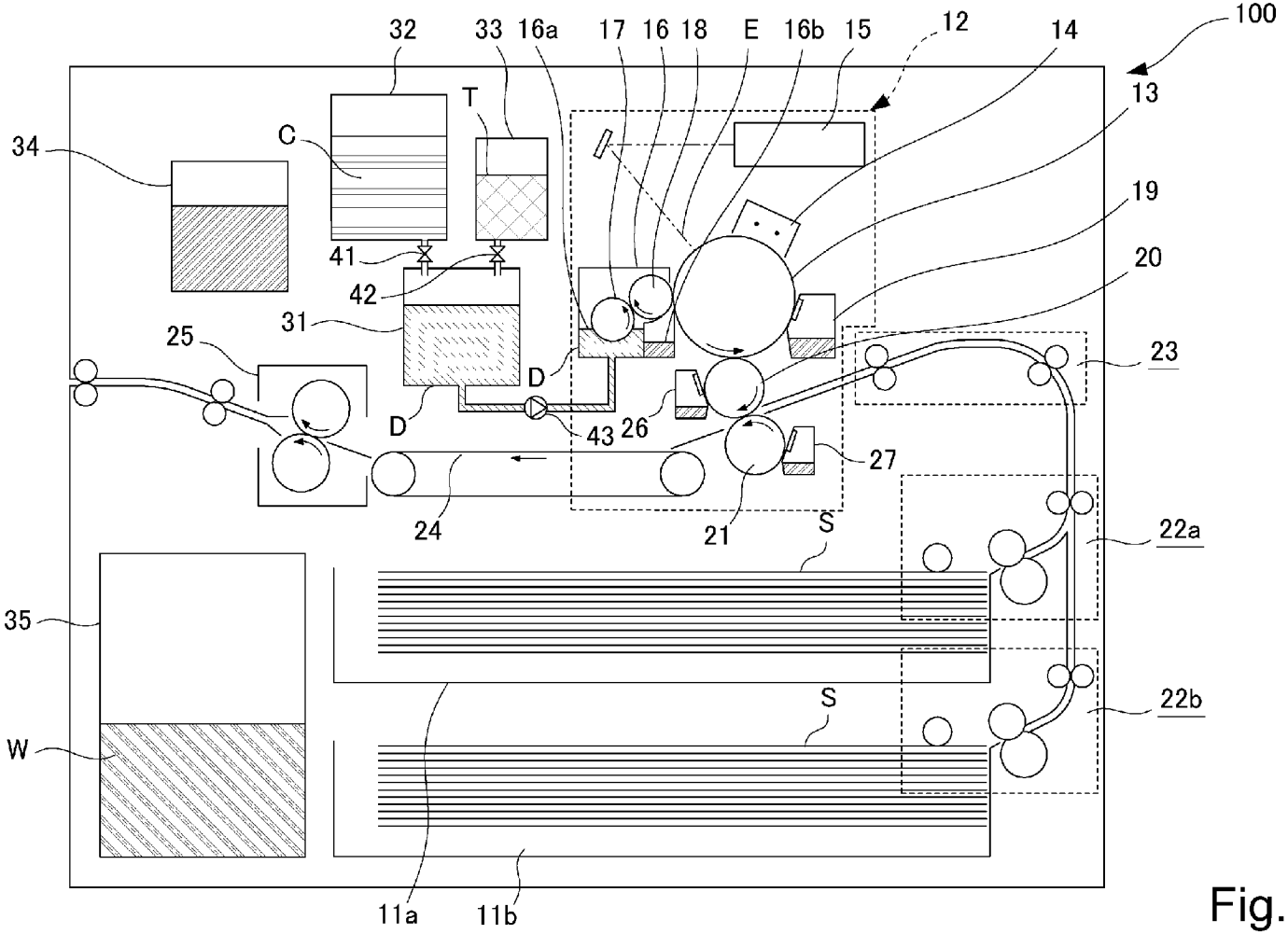
FIG. 1 is a schematic illustration of an image forming apparatus in an embodiment of the present invention.

An embodiment of the present invention will be described using FIGS. 1-14. First, a general structure of an image forming apparatus in this embodiment will be described using FIG. 1.

(Image Forming Apparatus)

An image forming apparatus 100 in this embodiment is a digital printer of an electrophotographic type in which a toner image is formed on a recording material (a sheet, a sheet material such as an OHP sheet and so on). The image forming apparatus 100 is operated on the basis an image signal, and a toner image formed by an image forming portion 12 is transferred onto a sheet as the recording material is successively fed from each of cassettes 11*a*, 11*b* and then is fixed on the sheet S, so that an image is obtained. The image signal is sent from an external terminal such as an unshown scanner or an unshown personal computer.

The image forming portion 12 includes a photosensitive drum as an image bearing member, a charger 14, a laser exposure device 15, a developing device 16 and a drum cleaner 19. A surface of the photosensitive drum 13 electrically charged by the charger 14 is irradiated with laser light E from the laser exposure device 15 depending on the first signal, so that an electrostatic latent image is formed on the photosensitive drum 13. This electrostatic latent image is developed as a toner image by the developing device 16. In this embodiment, in the developing device 16, a liquid developer D as a liquid material in which a powdery toner which is a dispersoid is dispersed in a carrier liquid which is a dispersion medium is accommodated, and development is effected using this liquid developer D.

The liquid developer D is generated by mixing and dispersing a toner T in a carrier liquid C in a predetermined ratio in a mixer 31 as a mixing device, and then is supplied to the developing device 16. The carrier liquid C is accommodated in a carrier tank 32 as a carrier container (collecting container), and the toner T is accommodated in a toner tank 33 as a toner container. Then, depending on a mixed state of the carrier liquid C and the toner T in the mixer 31, the carrier liquid C or the toner T is supplied from an associated tank. In the mixer 31, a stirring blade driven by an unshown motor is accommodated, and the developer liquid D is mixed with the carrier liquid C or the toner T by being stirred, so that the toner is dispersed in the carrier liquid.

The liquid developer supplied from the mixer 31 to the developing device 16 is coated (supplied) on a developing roller 18 as a developer carrying member and is used for development. The developing roller 18 carries and feeds the liquid developer D on a surface thereof, and develops with the toner the electrostatic latent image formed on the photosensitive drum 13 (first bearing member). The carrier liquid C and the toner T which remain on the developing roller 18 after the development is collected in a collecting section 16*b* of the developing device 16. Here, each coating of the liquid developer from a coating roller 17 onto the developing roller 18 and the development of the electrostatic latent image on the photosensitive drum 13 by the developing roller 18 is made using an electric field.

The toner image formed on the photosensitive drum 13 is transferred onto an intermediary transfer roller 20 using the electric field, and then is fed to a nip formed by the intermediary transfer roller 20 and a transfer roller 21. The toner T and the carrier liquid C which remain on the photosensitive drum 13 after the toner image transfer onto the intermediary transfer roller 20 are collected by the drum cleaner 19. Incidentally, at least one of the intermediary transfer roller 20 and the transfer roller 21 may also be an endless belt.

The sheet S accommodated in each of the cassettes 11*a*, 11*b* is fed toward a registration feeding portion 23 by an associated feeding portion 22*a* or 22*b* constituted by feeding rollers. The registration feeding portion 23 feeds the sheet S to the nip between the intermediary transfer roller 20 and the transfer roller 21 by being timed to the toner image transferred on the intermediary transfer roller 20.

In the nip between the intermediary transfer roller 20 and the transfer roller 21, the toner image is transferred onto the sheet S passing through the nip, and the sheet S on which the toner image is transferred is fed to a fixing device 25 by a feeding belt 24, so that the toner image transferred on the sheet S is fixed. The sheet S on which the toner image is fixed is discharged to an outside of the image forming apparatus, so that an image forming step is completed.

The intermediary transfer roller 20 and the transfer roller 21 are provided with an intermediary transfer roller cleaner 26 and a transfer roller cleaner 27, respectively, for collecting the toner T and the carrier liquid C which remain on the associated roller.

(Liquid Developer)

Next, the liquid developer develop will be described. As the liquid developer D, a conventionally used liquid developer may also be used, but in this embodiment, an ultraviolet-curable liquid developer D is used and will be described below.

The liquid developer D is an ultraviolet-curable liquid developer which contains a cation-polymerizable liquid monomer, a photo-polymerization initiator and toner particles insoluble in the cation-polymerizable liquid monomer. The cation-polymerizable liquid monomer is vinyl ether compound, and the photo-polymerization initiator is a compound represented by the following formula (1).

formula (1)

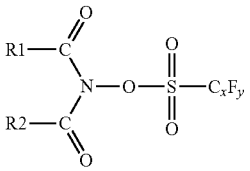

Specifically, first, the toner particles include a colorant and a toner resin material in which the colorant is incorporated. Together with the toner resin material and the colorant, another material such as a charge control agent may also be contained. As a manufacturing method of the toner particles, a well-known technique such as a coacervation in which the colorant is dispersed and a resin material is gradually polymerized so that the colorant is incorporated in the polymer or an internal pulverization method in which a resin material or the like is melted and the colorant is incorporated in the melted resin material may also be used. As the toner resin material, epoxy resin, styrene-acrylic resin or the like is used. The colorant may be a general-purpose organic or inorganic colorant. In the manufacturing method, in order to enhance a toner dispersing property, a dispersant is used but a synergist can also be used.

Next, a curable liquid which is the carrier liquid is constituted by the charge control agent for imparting electric charges to the toner surface, a photo-polymerization agent (initiator) for generating acid by ultraviolet (UV) irradiation and a monomer bondable by the acid. The monomer is a vinyl ether compound which is polymerizable by a cationic polymerization reaction. Separately from the photo-polymerization initiator, a sensitizer may also be contained. By photo-polymerization, a storage property lowers, and therefore a cationic polymerization inhibitor may also be added in an amount of 10-5000 ppm. In addition, a charge control aid, another additive or the like may also be used in some cases.

The UV curing agent (monomer) of the developer is a mixture of about 10% (weight %) of a monofunctional monomer having one vinyl ether group (formula 2 below) and about 90% (weight %) of difunctional monomer having two vinyl ether groups (formula 3 below).

formula 2

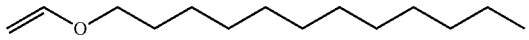

formula 3

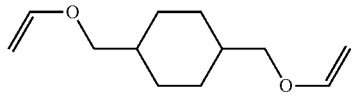

As the photo-polymerization initiator, 0.1% of a compound represented by formula 4 below is mixed. By using this photo-polymerization initiator, different from the case where an ionic photo-acid generator, a high-resistance liquid developer is obtained while enabling satisfactory fixing.

formula 4

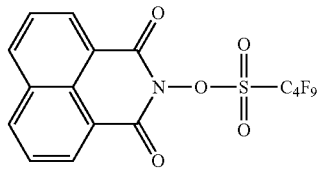

Incidentally, a cationic polymerizable liquid monomer may desirably be a compound selected from the group consisting of dichloropendadiene vinyl ether, cyclohexanedimethanol divinyl ether, tricyclodecane vinyl ether, trimethylolpropane trivinyl ether, 2-ethyl-1,3-hexamediol divinyl ether, 2,4-diethyl-1,5-pentanediol divinyl ether, 2-butyl-2-ethyl-1,3-propanediol divinyl ether, neopentylglycol divinyl ether, pentaerythritol tetravinyl ether, and 1,2-decanediol divinyl ether.

As the charge control agent, a well-known compound can be used. As a specific example, it is possible to use fats and oils such as linseed oil and soybean oil; alkyd resin; halogen polymer; oxidative condensates such as aromatic polycarboxylic acid, acidic group-containing water-soluble dye and aromatic polyamine; metallic soaps such as cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, and cobalt 2-ethylhexylate; sulfonic acid metal salts such as petroleum acid metal salt and metal salt of sulfosuccinic acid; phospholipid such as lectithin; salicylic acid metal salt such as t-butylsalicylic acid metal complex; polyvinyl pyrrolidone resin; polyamide resin; sulfonic acid-containing resin; and hydroxybenzoic acid derivative.

(Feeding of Liquid Developer)

Figure 2:
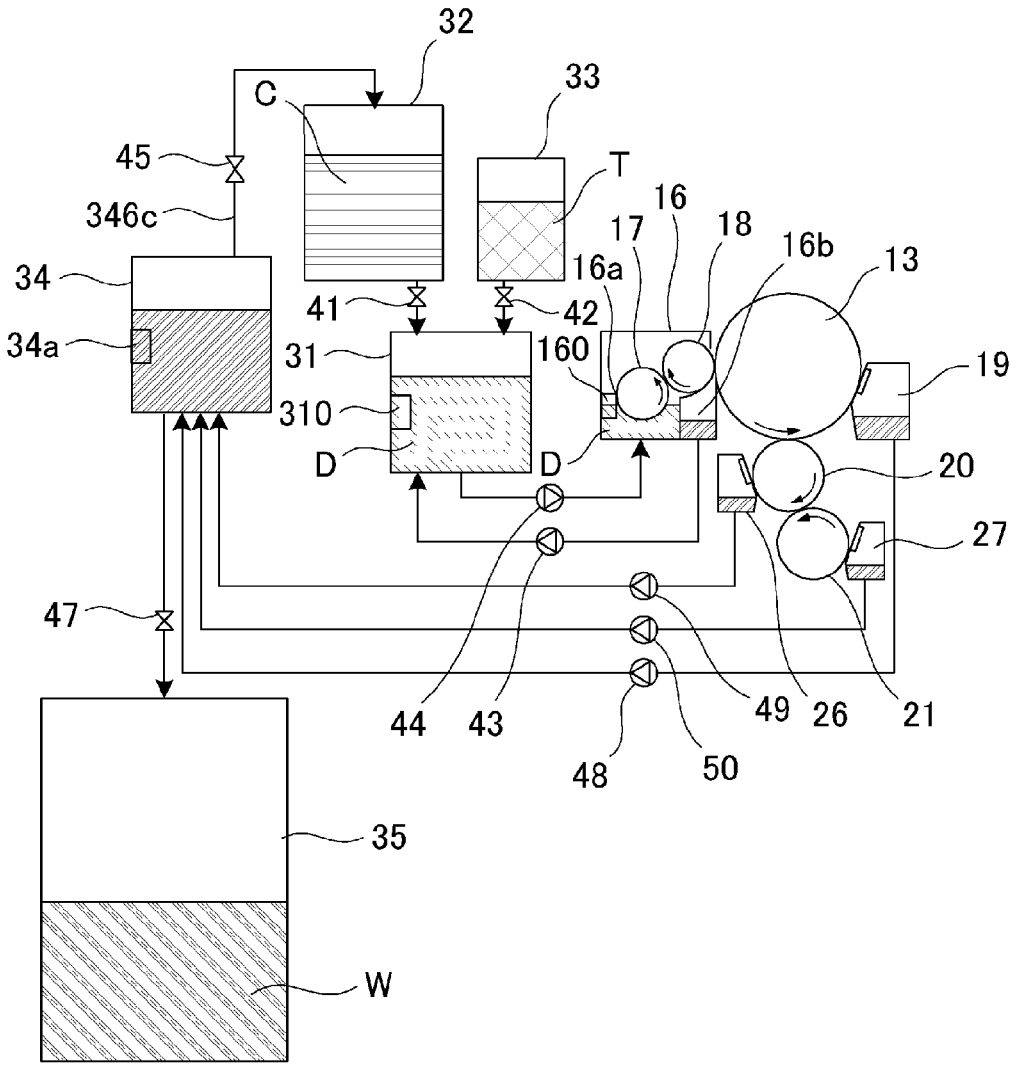
FIG. 2 is a schematic illustration showing a feeding path of a liquid developer in the image forming apparatus in the embodiment.

Next, feeding of the liquid developer D in this embodiment will be described using FIGS. 2 to 4. First, as described above, the developer collected at the image forming portion 12 including the drum cleaner 19, the intermediary transfer roller cleaner 26 and the transfer roller cleaner 27 is subjected to separation between the toner and the carrier liquid, so that the carrier liquid is used again. Incidentally, the developer which remains on the developing roller 18 after development and which is collected into the collecting section 16*b* of the developing device is returned to the mixer 31, but may also be fed to a separation and extraction device 34.

Although details will be described later, the separation and extraction device 34 separates a reusable carrier liquid and a waste liquid W containing the toner and an impurity such as paper powder when the carrier liquid and the toner are separated from each other, so that the separated waste liquid W is collected in a waste liquid collecting container 35.

Specifically, a transporting pipe from the carrier tank 32 to the mixer 31 and a transporting pipe from the toner tank 33 to the mixer 31 are provided with electromagnetic valves 41 and 42, respectively, and a supply amount of the carrier liquid C to the mixer 31 and a supply amount of the toner T to the mixer 31 are adjusted. From the mixer 31, the liquid developer D necessary for the development is supplied using a pump 44.

The developer collected in the collecting container 16*b* of the developing device 16 is returned to the mixer 31 by a pump 43. This is because the developer collected in the collecting container 16*b* is little used for the development or the like and therefore is little deteriorated.

The residual carrier liquid and the residual toner which are collected by the drum cleaner 19, the intermediary transfer roller cleaner 26 and the transfer roller cleaner 27 are fed to the separation and extraction device 34 by pumps 48, 49 and 50, respectively.

The reusable carrier liquid separated by the separation and extraction device 34 is fed to the carrier tank 32 by an electromagnetic valve 45. On the other hand, the waste liquid separated by the separation and extraction device 34 is appropriately fed to the waste liquid collecting container 35 by an electromagnetic valve 47 provided to a transporting pipe through self-weight fall.

Transportation of the liquid developer and the like may also be made by, other than the use of the pump, using a feeding type using a self-weight of the liquid developer and the like, for example, in the case where the liquid developer and the like can be fed by the self-weight fall.

Figure 3:
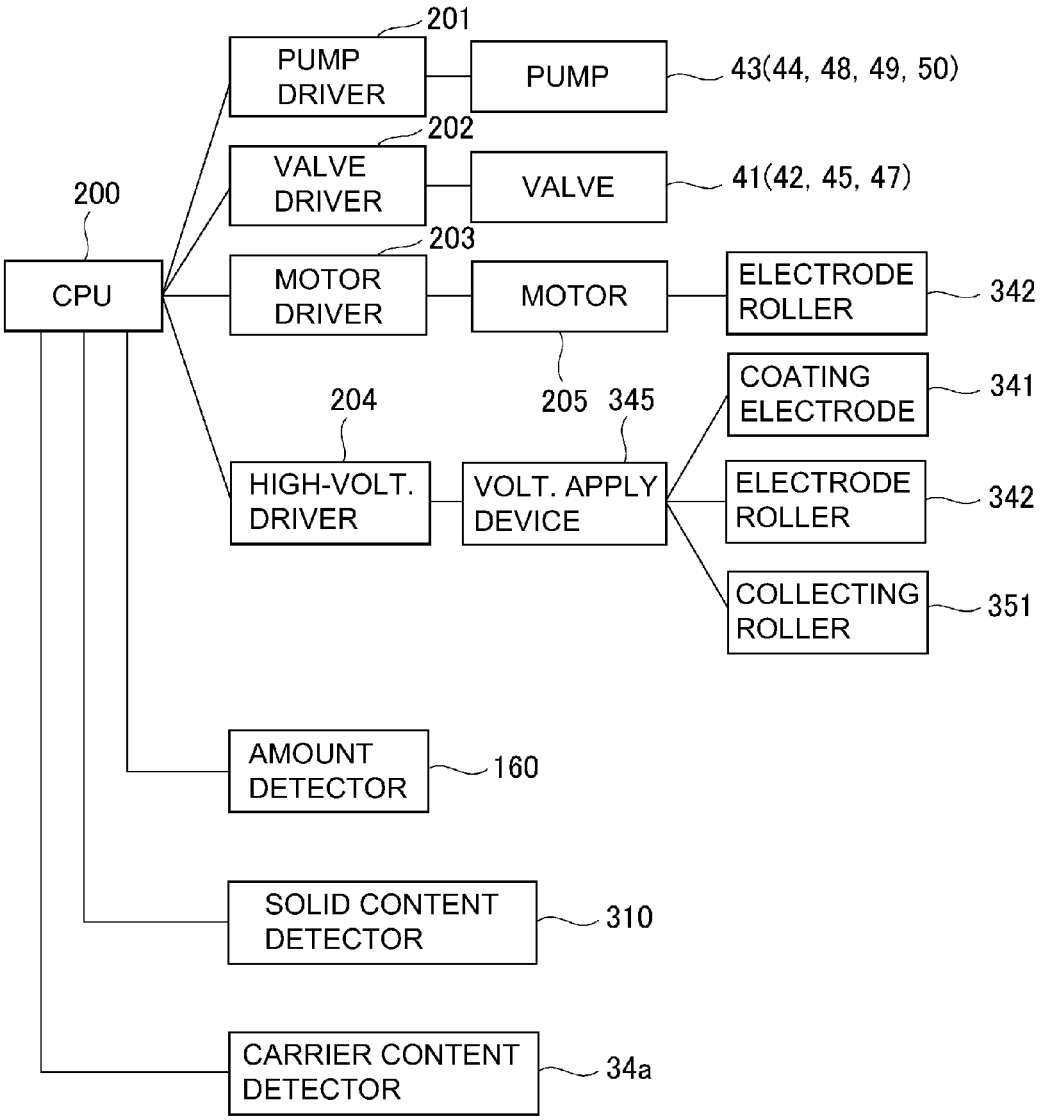
FIG. 3 is a control block diagram of a feeding operation of the liquid developer in the image forming apparatus in the embodiment.

As shown in FIG. 3, the above-described pumps 43, 44, 48, 49, 50 and electromagnetic valves 41, 42, 45, 47 are controlled by a CPU 200 as a controller through a pump driver 201 and an electromagnetic valve driver 202, respectively. The CPU 200 controls the respective pumps and the like on the basis of detection values of a developer amount detecting device 160, a solid component content detecting device 310 and a carrier liquid content detecting device 34*a*.

A feeding operation of the liquid developer will be described using FIG. 4 while making reference to FIGS. 2 and 3. First, as shown in FIGS. 2 and 3, the developing device 16 is provided with the developer amount detecting device 160, so that an amount of the liquid developer in the developing device 16 is detected by the developer amount detecting device 160. Further, the mixer 31 is provided with the solid component content detecting device 310, so that a content of a solid component such as the toner in the mixer 31 is detected. The solid component content detecting device 310 is, for example, provided with a light-emitting portion and a light-receiving portion, and a portion where the liquid in the mixer 31 passes is irradiated with light from the light-emitting portion and then the light passing through the portion is received by the light-receiving portion. Depending on the amount of the solid component at this portion, a light quantity of the light received by the light-receiving portion changes, and therefore depending on the change in light quantity, the content of the solid component in the mixer 31 can be detected.

Figure 4:
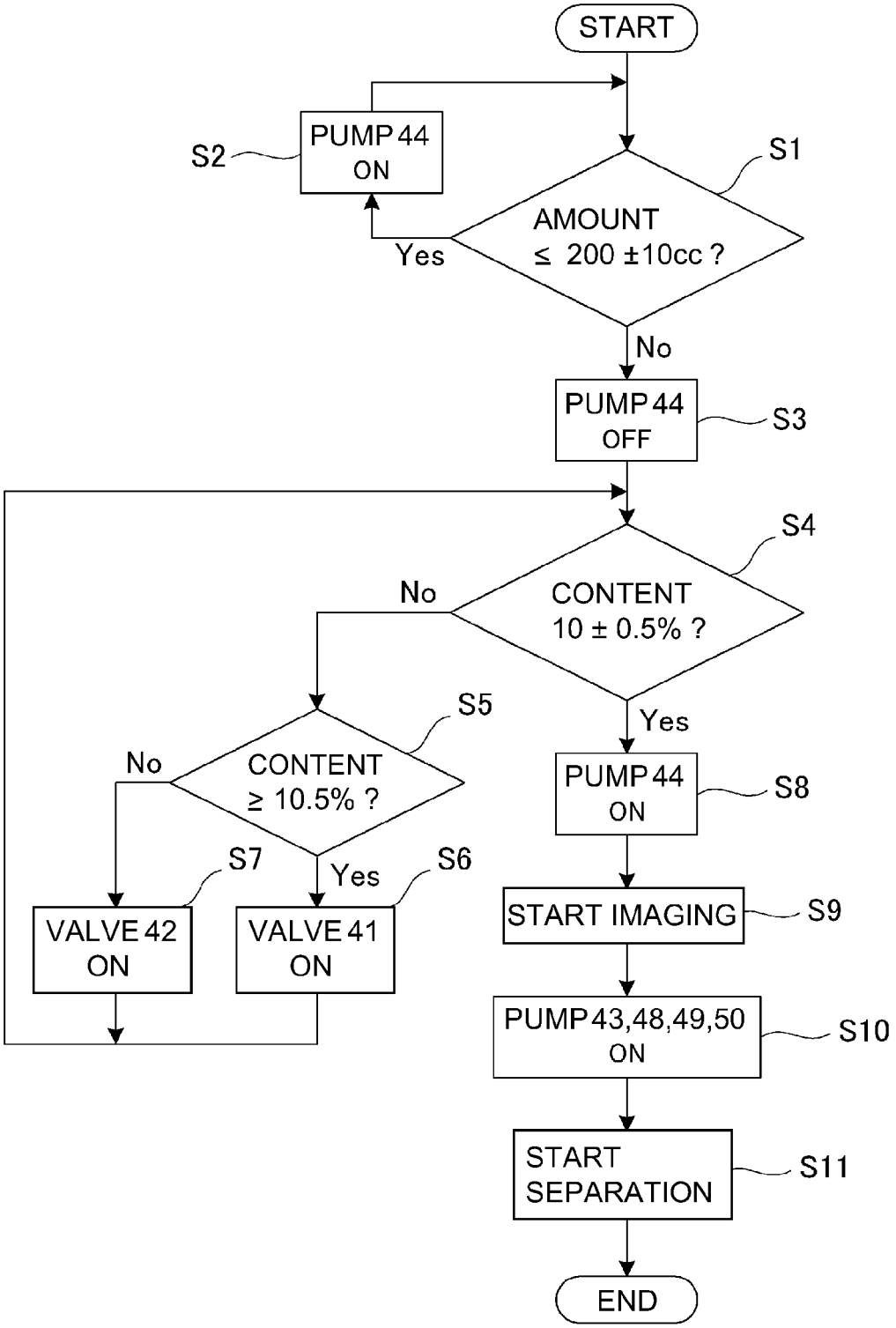
FIG. 4 is a flowchart showing control of the feeding operation of the liquid developer in the image forming apparatus in the embodiment.

As shown in FIG. 4, a developer amount in the developing device 16 is detected by the developer amount detecting device 160 (S1). Then, in the case where the developer amount in the developing device 16 is not more than a predetermined amount (e.g., 200±10 cc), the CPU 200 drives the pump 44 (S2), so that adjustment of the liquid developer amount in the developing device 16 is made. After the adjustment, the drive of the pump 44 is stopped (S3).

Then, the content of the solid component in the mixer 31 is detected by the solid component content detecting device 310 (S4). In the case where the content of the solid component in the mixer 31 is out of a predetermined range (e.g., 10±0.5%), the CPU 200 discriminates whether or not the solid component content is 10.5% or more (S5). In the case where the solid component content is 10.5% or more, the electromagnetic valve 41 is opened, so that the carrier liquid is supplied from the carrier tank 32 into the mixer 31 (S6). On the other hand, in the case where the solid component content is not 10.5% or more, i.e., in the case where the solid component content is 9.5% or less, the electromagnetic valve 42 is opened, so that the toner is supplied from the toner tank 33 into the mixer 31 (S7). As a result, content adjustment of the liquid developer in the mixer 31 is made.

That is, in the case where a toner content (solid component content) is high, the carrier liquid is supplied from the carrier tank 32 to the mixer 31 through the electromagnetic valve 41. Further, in the case where the toner content is low, the liquid developer higher in toner content than the liquid developer used in the mixer 31 is supplied from the toner tank 33 to the mixer 31 through the electromagnetic valve 42.

When the solid component content in the mixer 31 falls within the predetermined range, the pump 44 is driven as desired, and then the liquid developer subjected to the content adjustment is supplied from the mixer 31 to the developing device 16 (S8). Then, image formation is started (S9), and at the same time, drive of the pumps 43, 48, 49, 50 is also started (S10), and also drive of the separation and extraction device 34 is started (S11).

(Separation and Extraction Device)

Next, using FIGS. 5 to 11, the separation and extraction device 34 as a separating device will be specifically described. The separation and extraction device 34 is a device for separating the liquid developer into the toner and the carrier liquid using the electric field and for separately extracting the carrier liquid and the toner.

Figure 5:
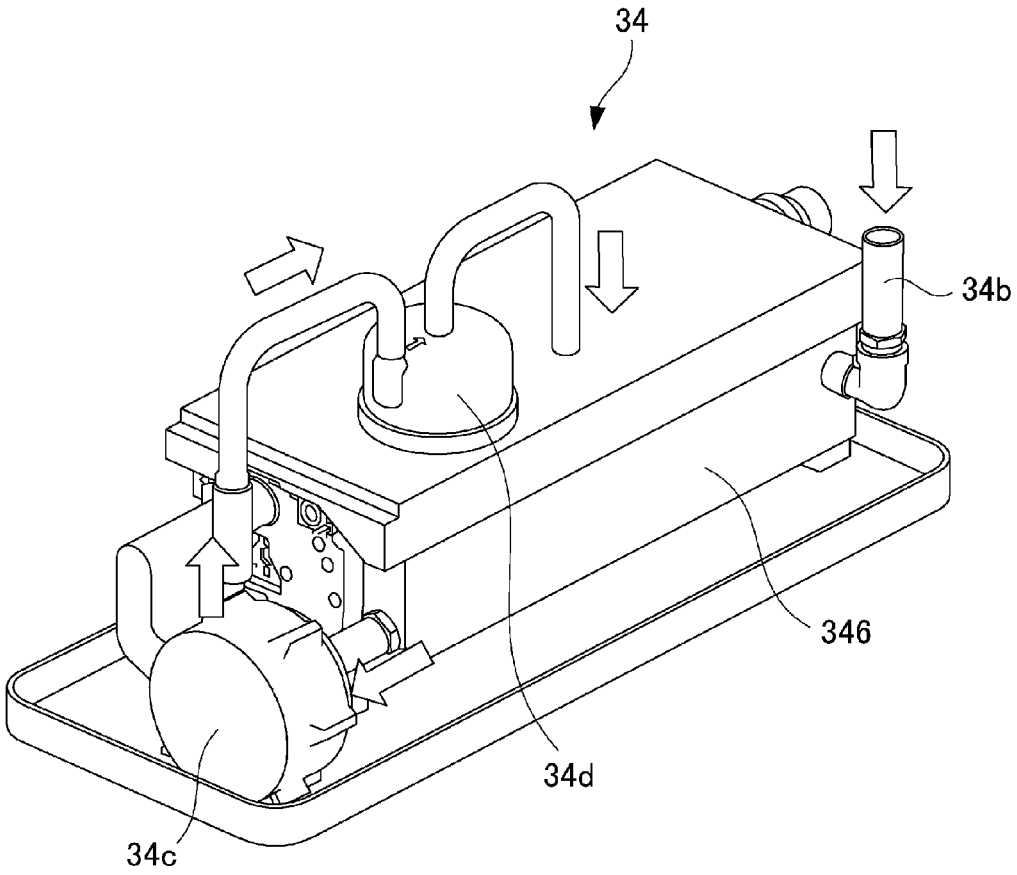
FIG. 5 is a perspective view of a separation and extraction device in the embodiment.
Figure 6:
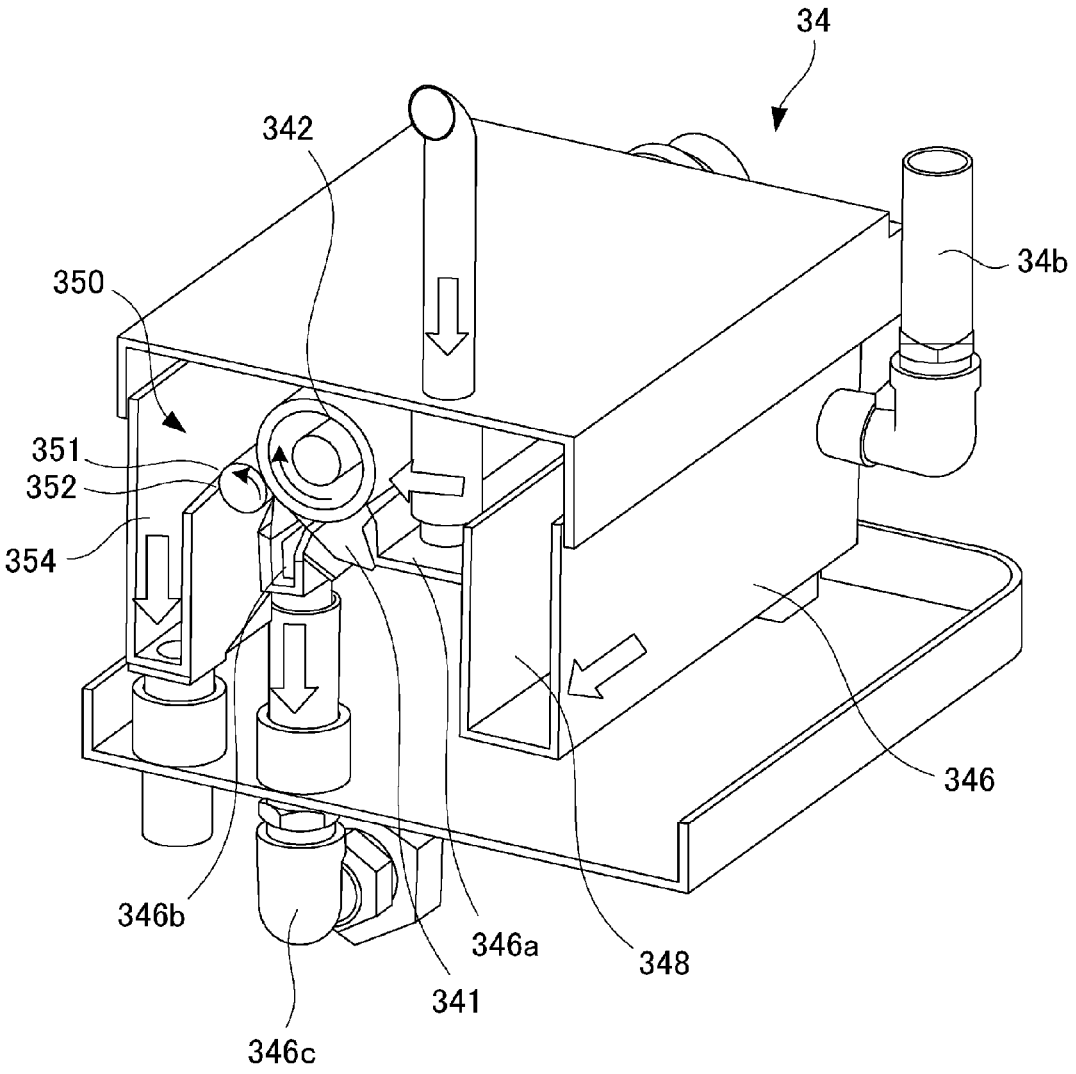
FIG. 6 is a partially cut perspective view showing the separation and extraction device in the embodiment.

As described above, the liquid developer collected at the image forming portion 12 such as the drum cleaner 19 is fed from an inlet 34*b* of the separation and extraction device 34 into a liquid accommodating container 346 as show by arrows in FIGS. 5 and 6. Then, the liquid developer is supplied to a buffer container 348 in the liquid accommodating container 346. In this embodiment, the buffer container 348 is provided in the separation and extraction device 34, but may also be provided separately as a single member. The liquid developer supplied to the buffer container 348 is fed by a pump 34*c* and passes through a filter 34*d*.

The liquid developer passed through the filter 34*d* is poured on a supply tray 346*a* as a supplying portion as shown in FIG. 6. As described later specifically, the liquid developer poured on the supply tray 346*a* is separated into the toner and the carrier liquid by the separation and extraction device 34. Then, the extracted toner is sent to the waste liquid collecting container 35, and the extracted carrier liquid is fed to the carrier tank 32.

Figure 7:
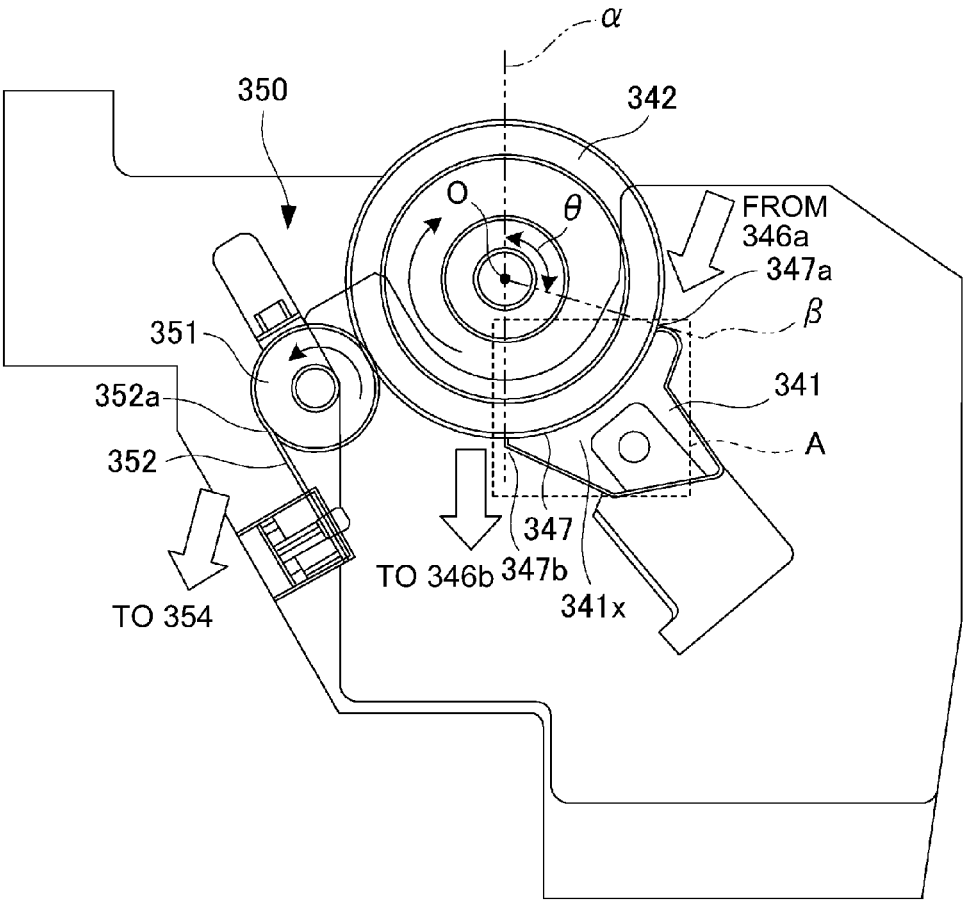
FIG. 7 is a sectional view showing a part of the separation and extraction device in the embodiment.

Next, a constitution of separation and extraction of the toner and the carrier liquid in the separation and extraction device 34 will be described. As shown in FIGS. 6 and 7, in the liquid accommodating container 346, a coating electrode member 341 as an external electrode member, an electrode roller 342 as an electroconductive roller, a toner collecting device 350 and the like are provided. The liquid accommodating container 346 is a container capable of accommodating the liquid developer and includes the above-described supply tray 346*a*, a discharge portion 346*b* through which a reusable carrier liquid is to be discharged as described later, and a collecting portion 354 for collecting the developer which is the waste liquid.

The electrode roller 342 is an electroconductive roller which is, for example, formed by integrally molding a core metal, formed with a solid stainless steel material in an outer diameter of 40 mm, with an urethane rubber elastic layer formed on a surface of the core metal. As shown in FIG. 3, a driving force is externally inputted into the electrode roller 342 by a driving motor 205, so that the electrode roller 342 is rotated in a predetermined direction (arrow directions of FIGS. 6 and 7). In this embodiment, a rotational speed of the driving motor 205 is 2000 rpm. Then, the electrode roller 342 is rotated at a rotational speed of, e.g., 400 rpm by reducing the rotational speed of the driving motor 205 by a speed reducer. Incidentally, a voltage applying device 345 is controlled by the CPU 200 through a high-voltage driver 204, and the driving motor 205 is controlled by the CPU 200 through a motor driver 203.

Figure 8:
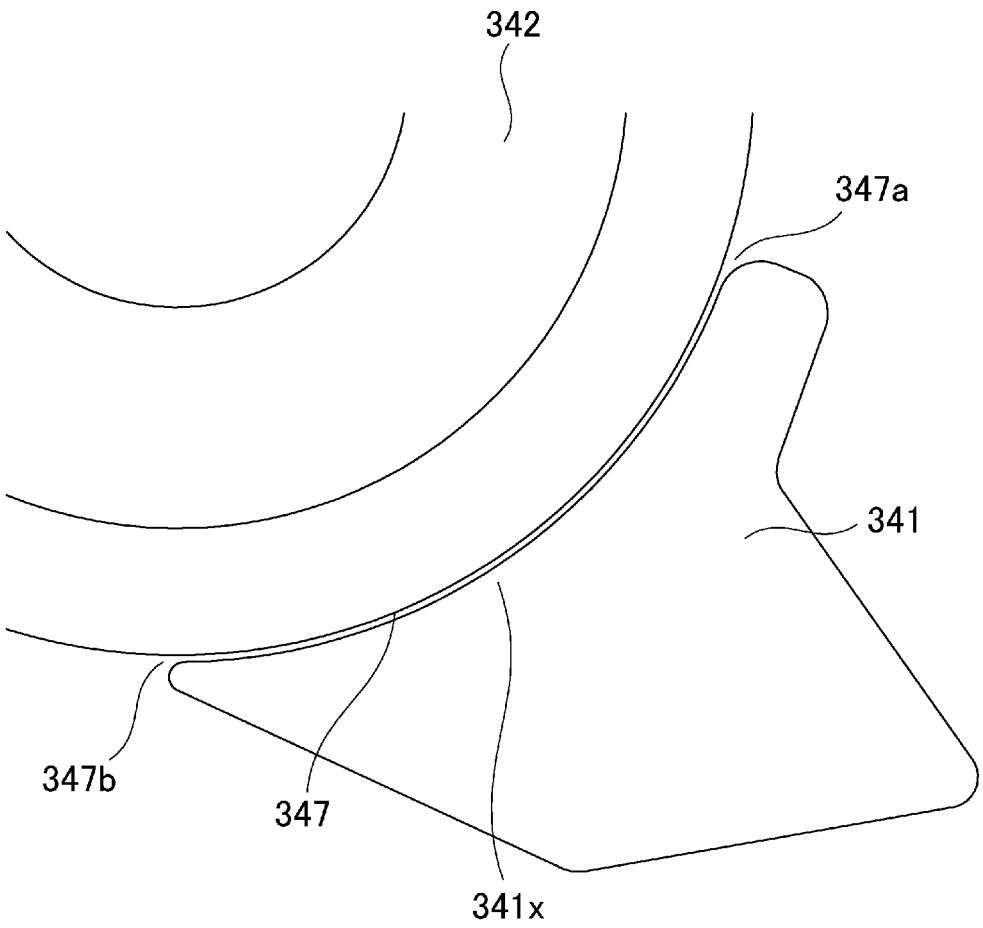
FIG. 8 is an enlarged view of portion A in FIG. 7.

The coating electrode member 341 is disposed with a gap 347 with a part of the electrode roller 342 as shown in FIGS. 7 and 8. With an upstream end portion 347*a* of the gap 347 with respect to a rotational direction of the electrode roller 342, the supply tray 346*a* is connected. Further, the liquid developer poured in the supply tray 346*a* as described above is supplied into the gap 347 through the upstream end portion 347*a*. The gap 347 is sealed at both end portions thereof with respect to a rotational axis direction of the electrode roller 342, so that the liquid developer supplied into the gap 347 is fed through the gap 347 toward a downstream side of the gap 347 with respect to the rotational direction of the electrode roller 342 with rotation of the end portion 342. With a downstream end portion 347*a* of the gap 347 with respect to the rotational direction of the electrode roller 342, the discharge portion 346*b* is connected (FIG. 6). Further, the liquid developer passed through the gap 347 is sent to the carrier tank 32 through the discharge portion 346*b* via a transporting pipe 346*c* (FIGS. 2 and 6).

Incidentally, the transporting pipe 346*c* is connected with also a path through which the discharge liquid developer is returned to the separation and extraction device 34 again. The discharge portion 346*b* is provided with the carrier liquid content detecting device 34*a*, so that the toner content in the carrier liquid of the liquid developer sent into the discharge portion 346*b* is detected. A constitution of the carrier liquid content detecting device 34*a* is the same as the constitution of the above-described solid component content detecting device 310. Further, in the case where the toner content of the liquid developer sent to the discharge portion 346*b* is larger than a predetermined value (e.g., 0.02%), the liquid developer is returned to the separation and extraction device 34 again, so that the separation of the liquid developer into the toner and the carrier liquid is effected.

This is because, for example, the case where an abnormal situation such that a power source is shut down during an operation of the separation and extraction device 34 generates and thus the carrier liquid and the toner cannot be sufficiently separated from each other by the separation and extraction device 34 is assumed. In such a case, the toner content of the liquid developer sent to the discharge portion 346*b* is larger than the predetermined value, and therefore in this case, the liquid developer is returned to the separation and extraction device 34. Ordinarily, as described later, the liquid developer passes through the gap 347, so that the toner and the carrier liquid are separated from each other and then the extracted carrier liquid is sent to the discharge portion 346*b*. Accordingly, the toner content of the liquid developer sent to the discharge portion 346*b* is not more than the predetermined value, so that the carrier liquid is sent to the carrier tank 32 without being returned to the separation and extraction device 34. Incidentally, such a path for returning the carrier liquid to the separation and extraction device 34 may also be omitted.

As described above, the coating electrode member 341 disposed opposite to the electrode roller 342 with the gap 347 is formed of an electroconductive material at least at a surface of a portion 341*x* on which the liquid passes through the gap 347. The coating electrode member 341 is formed of, e.g., a solid stainless steel material in width of 400 mm. The portion 341*x* on which the liquid passes has a shape of accommodating a part of the electrode roller 342, and an opposing surface of the portion 341*x* to the electrode roller 342 has a curved shape such that a predetermined distance (i.e., the gap 347) is maintained between the opposing surface and the surface of the electrode roller 342. This predetermined distance is, e.g., 0.2 mm.

As shown in FIG. 3, with the coating electrode member 341 and the electrode roller 342, the voltage applying device 345 as a voltage applying means is connected. Further, between the coating electrode member 341 and the electrode roller 342, a voltage is applied by the voltage applying device 345 so that an electric field for moving the toner toward the electrode roller 342 side. That is, to the gap 347, a voltage such that an electric field for attracting the toner to the electrode roller 342 is generated is applied.

In this embodiment, the toner is negatively charged by the charge control agent, and therefore for example, a voltage of −300 V is applied to the electrode roller 342, and a voltage of −1000 V is applied to the coating electrode member 341. Thus, the toner in the liquid developer passing through the gap 347 is moved from the coating electrode member 341 to the electrode roller 342. As a result, during the passing of the liquid developer through the gap 347, the toner is carried on the electrode roller 342, so that the toner and the carrier liquid are separated from each other. The separated carrier liquid is discharged to the discharge portion 346*b* connected with the downstream end portion 347*b* of the gap 347, and then is sent to the carrier tank 32 as a collecting container as described above.

The toner collecting device 350 is positioned downstream of the coating electrode member 341 with respect to the rotational direction of the electrode roller 342, and collects the toner carried on the electrode roller 342. The toner collecting device 350 includes a collecting roller 351, the voltage applying device 345 as a collecting voltage applying means, and a blade member 352 as a scraping member.

The collecting roller 351 is an electroconductive roller formed of, e.g., a solid stainless steel material in an outer diameter of 20 mm, and is provided in contact with the electrode roller 342. Further, the collecting roller 351 contacts the electrode roller 342 and is rotated by the electrode roller 342 in arrow directions of FIGS. 6 and 7. Incidentally, a rotational speed of the collecting roller 351 is, e.g., 800 rpm.

Figure 9:
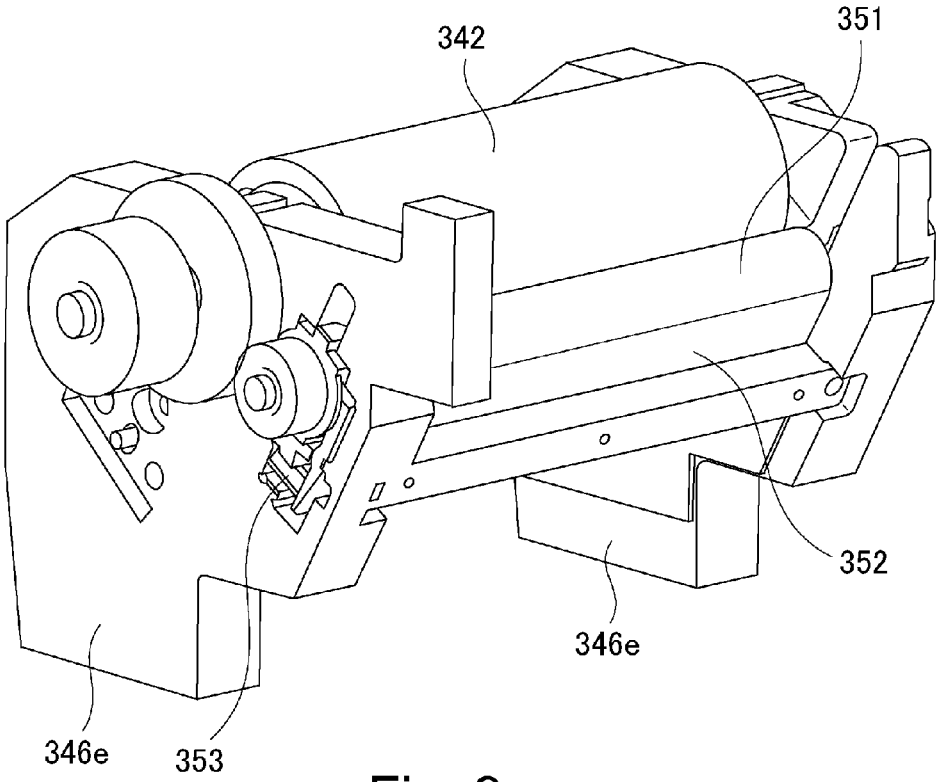
FIG. 9 is a perspective view showing a part of the separation and extraction device in the embodiment.
Figure 10:
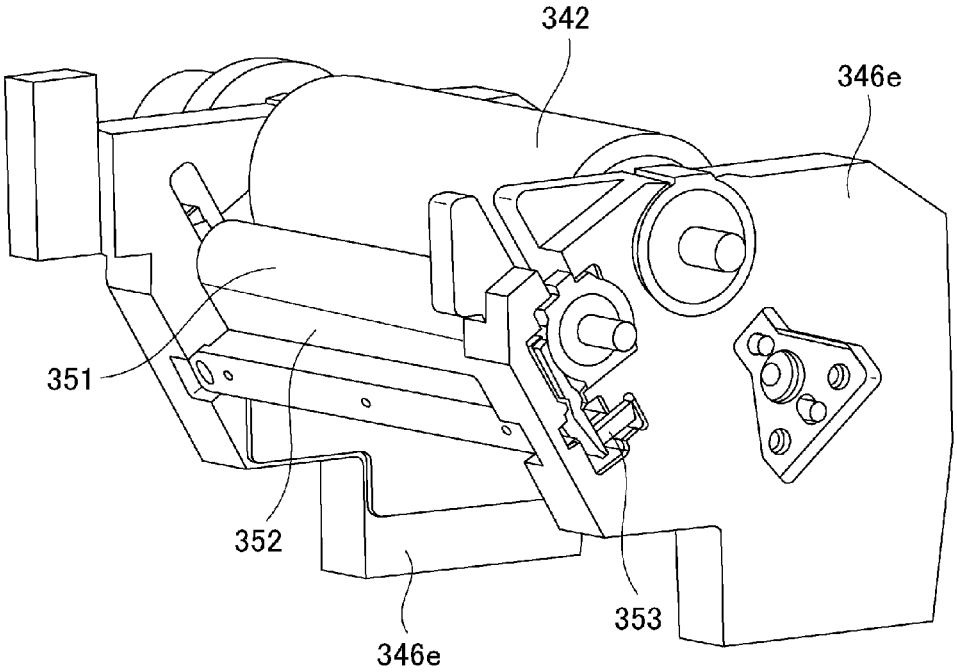
FIG. 10 is a perspective view showing the part of the separation and extraction device in the embodiment as seen from an angle different from an angle in FIG. 9.
Figure 11:
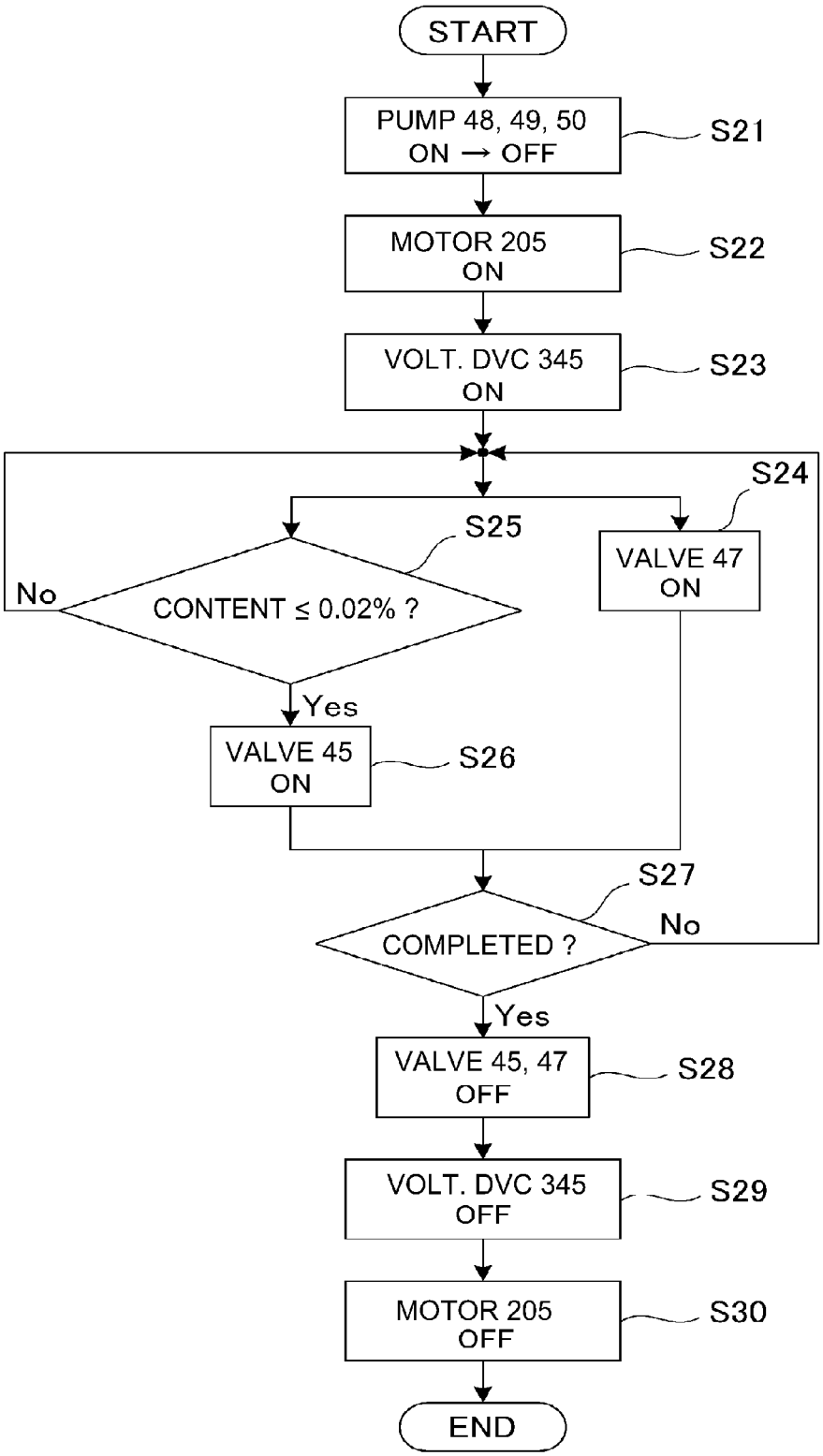
FIG. 11 is a flowchart showing control of a separation and extraction operation of the liquid developer in the embodiment.

As shown in FIGS. 9 and 10, the electrode roller 342 and the collecting roller 351 are disposed substantially parallel to each other, and both end portions of these rollers 342 and 351 with respect to a rotational axis direction are rotatably supported by frames 346*e* constituting the liquid accommodating container 346. At both end portions of the collecting roller 351, urging mechanisms 353 such as springs are provided. The collecting roller 351 is urged toward the electrode roller 342 by the urging mechanisms 353, so that the electrode roller 342 is elastically deformed. An urging force for urging the collecting roller 351 toward the electrode roller 342 by the urging mechanisms 353 is, e.g., 3 kgf (29.4 N).

The coating electrode member 341 and the collecting roller 351 are positioned on the basis of the electrode roller 342, so that the electrode roller 342 is a positional basis for these members 341 and 351.

The voltage applying device 345 is connected with the electrode roller 342 and the collecting roller 351 as shown in FIG. 3, and applies a voltage to between the collecting roller 351 and the electrode roller 342 so that an electric field for moving the toner toward the collecting roller 351 is generated. In this embodiment, the voltage applying device connected with the electrode roller 342 and the collecting roller 351 and the voltage applying device connected with the electrode roller 342 and the coating electrode member 341 are used in common, but may also be separately provided. In this embodiment, for example, a voltage of −300 V is applied to the electrode roller 342, and a voltage of −200 V is applied to the collecting roller 351. Thus, the toner which is carried on the electrode roller 342 and which is fed toward the collecting roller 351 is moved from the electrode roller 342 scrapes to the collecting roller 351.

The blade member 352 scrapes solid components off the toner on the collecting roller 351 in contact with the collecting roller 351. The blade member 352 is disposed at a position downstream of a position of contact between the electrode roller 342 and the collecting roller 351 with respect to a rotational direction of the collecting roller 351 so that the blade member 352 contacts the collecting roller 351 with respect to a counter direction to the rotational direction of the collecting roller 351. The blade member 352 is urged so that a free end portion 351*a* thereof contacts the surface of the collecting roller 351. Incidentally, the counter direction is a direction such that a direction in which the free end portion 352*a* contacting the surface of the collecting roller 351 extends is opposite to a tangential direction along the rotational direction of the collecting roller 351. Further, the blade member 352 is a plate(-like) member extending along a longitudinal direction (rotational axis direction) of the collecting roller 351 and for example, a stainless steel material is used as a material of the collecting roller 351.

As described above, the toner moved from the electrode roller 342 to the collecting roller 351 is scraped off by the blade member 352 and then is sent to the collecting portion 354 as a toner collecting portion. The toner collected in the collecting portion 354 is sent to the waste liquid collecting container 35 as described above. Incidentally, a scraping member for scraping the toner off the collecting roller 351 is not limited to the blade member. For example, the blade member may also be formed in a brush shape other than the blade shape.

(Positional Relation Between End Portions of Gap)

In the case of this embodiment, as described above, the liquid developer which is collected at the image forming portion 12 and which is supplied from the supply tray 346*a* to the gap 347 passes through the gap 347, so that the liquid developer is separated into the toner and the carrier liquid. Here, the liquid flows from above to below along a direction of gravitation. For this reason, it is undesirable that the downstream end portion 347*b* (outlet) through which the liquid developer passed through the gap 347 is to be discharged is positioned above the upstream end portion 347*a* (inlet), through which the liquid developer is to be supplied into the gap 347, with respect to the direction of gravitation. For a similar reason, it is undesirable that the discharge portion 346*b* is positioned above the upstream end portion 347*a* (inlet) with respect to the direction of gravitation.

Particularly, in order to enhance a reuse factor of the carrier liquid, it is preferable that a T/D ratio (mixing ratio between the toner and the carrier liquid) of the developer at the toner scraping portion (contact position of the blade member 352) is increased to the possible extent. However, the liquid developer having a high T/D ratio has a higher viscosity, so that a developer feeding property lowers, and therefore when the outlet of the gap 347 is positioned above the inlet of the gap 347, a recycling efficiency lowers.

Therefore, in this embodiment, as shown in FIG. 7, in the case where a line $\alpha$ passing through a center O of the electrode roller 342 and a top of the electrode roller 342 with respect to the direction of gravitation is 0°, the upstream end portion 347*a* of the gap 347 is positioned in a range of 0° or more and less than 180° with respect to the rotational direction of the electrode roller 342. In other words, an angle formed between the line $\alpha$ and a line $\beta$ passing through the upstream end portion 347*a* of the gap 347 and the center O is $\theta$, the upstream end portion 347*a* is positioned so that the angle $\theta$ is 0° or more and less than 180°. In a preferred example, the upstream end portion 347*a* of the gap 347 is positioned in a range of 60° or more and 120° or less with respect to the rotational direction of the electrode roller 342. In this embodiment, the upstream end portion 347*a* is positioned in a range from 90° to 120° with respect to the rotational direction of the electrode roller 342.

The downstream end portion 347*b* of the gap 347 is positioned below the upstream end portion 347*a* with respect to the direction of gravitation. In a preferred example, the downstream end portion 347*b* of the gap 347 is positioned in a range of 180° or less with respect to the rotational direction of the electrode roller 342. That is, it is preferable that the downstream end portion 347*b* is positioned in a range which includes the position of 180° and in which the downstream end portion 347*b* is positioned upstream of the position of 180° with respect to the rotational direction of the electrode roller 342. As a result, the liquid developer passing through the gap 347 is prevented from being fed against gravitation, so that the reuse efficiency can be further enhanced. In this embodiment, the downstream end portion 347*b* is in the position of 180° with respect to the rotational direction of the electrode roller 342.

Incidentally, a length of the gap 347, i.e., a length from the upstream end portion 347*a* to the downstream end portion 347*b* along the electrode roller 342 may preferably be not less than ⅕ of a peripheral length of an outer peripheral surface of the electrode roller 342. This length of the gap 347 may also be set depending on the rotational speed of the electrode roller 342. For example, in the case where the rotational speed of the electrode roller 342 is slow, the length of the gap 347 can be shortened. In summary, it is only required that a length in which the toner and the carrier liquid are separated from each other is ensured during the passing of the liquid developer through the gap 347.

(Control Flow of Separation and Extraction Operation of Liquid Developer)

Next, a control flow of a separation and extraction operation of the liquid developer in this embodiment constituted as described above will be described using FIGS. 11 and 12. First, the respective pumps 48, 49, 50 are driven, so that the developers collected by the drum cleaner 19, the intermediary transfer roller cleaner 26 and the transfer roller cleaner 27 are fed to the separation and extraction device 34. Then, after the developers in a predetermined amount are sent to the separation and extraction device 34, the drive of the pumps 48, 49, 50 is stopped (S21).

Then, the drive of the driving motor 205 is started, so that the electrode roller 342 is rotated (S22). As a result, the liquid developer is fed with rotation of the electrode roller 342. At this time, the collecting roller 351 is rotated by the electrode roller 342. Further, the voltage applying device 345 is turned on (S23). As a result, a voltage is applied to between the coating electrode member 341 and the electrode roller 342 so that an electric field for moving the toner toward the electrode roller 342 is generated, and a voltage is applied to between the collecting roller 351 and the electrode roller 342 so that an electric field for moving the toner toward the collecting roller 351 is generated. For this reason, the toner in the liquid developer is first moved toward the electrode roller 342 and then is moved toward the collecting roller 351. The carrier liquid having no electric charge remains on the coating electrode member 341 side.

Figure 12:
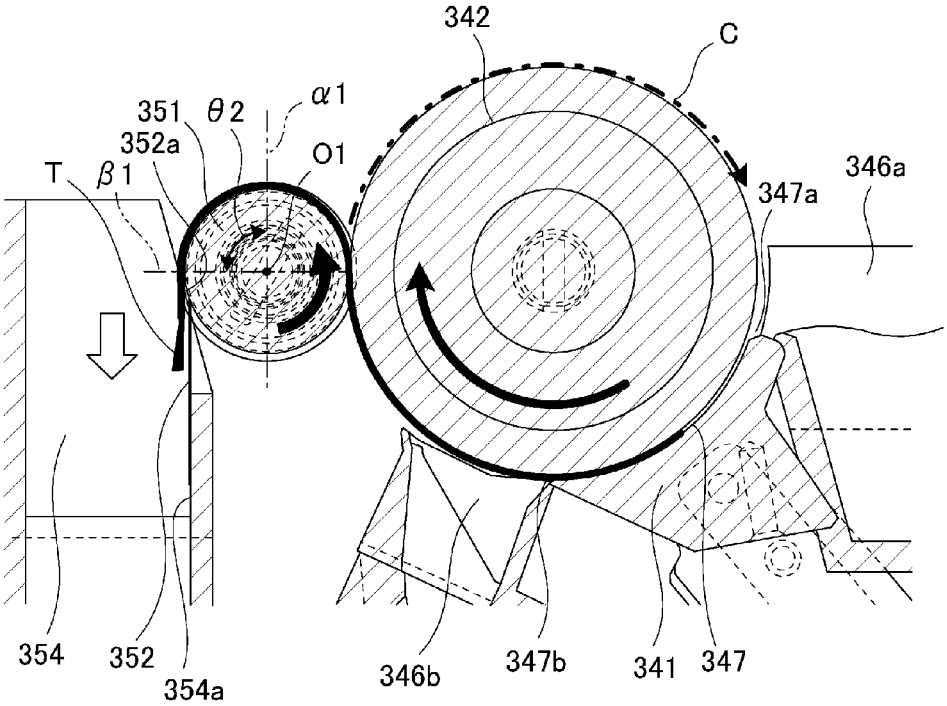
FIG. 12 is a sectional view, showing a part of the separation and extraction device in the embodiment, for illustrating a flow of a toner.
Figure 15:
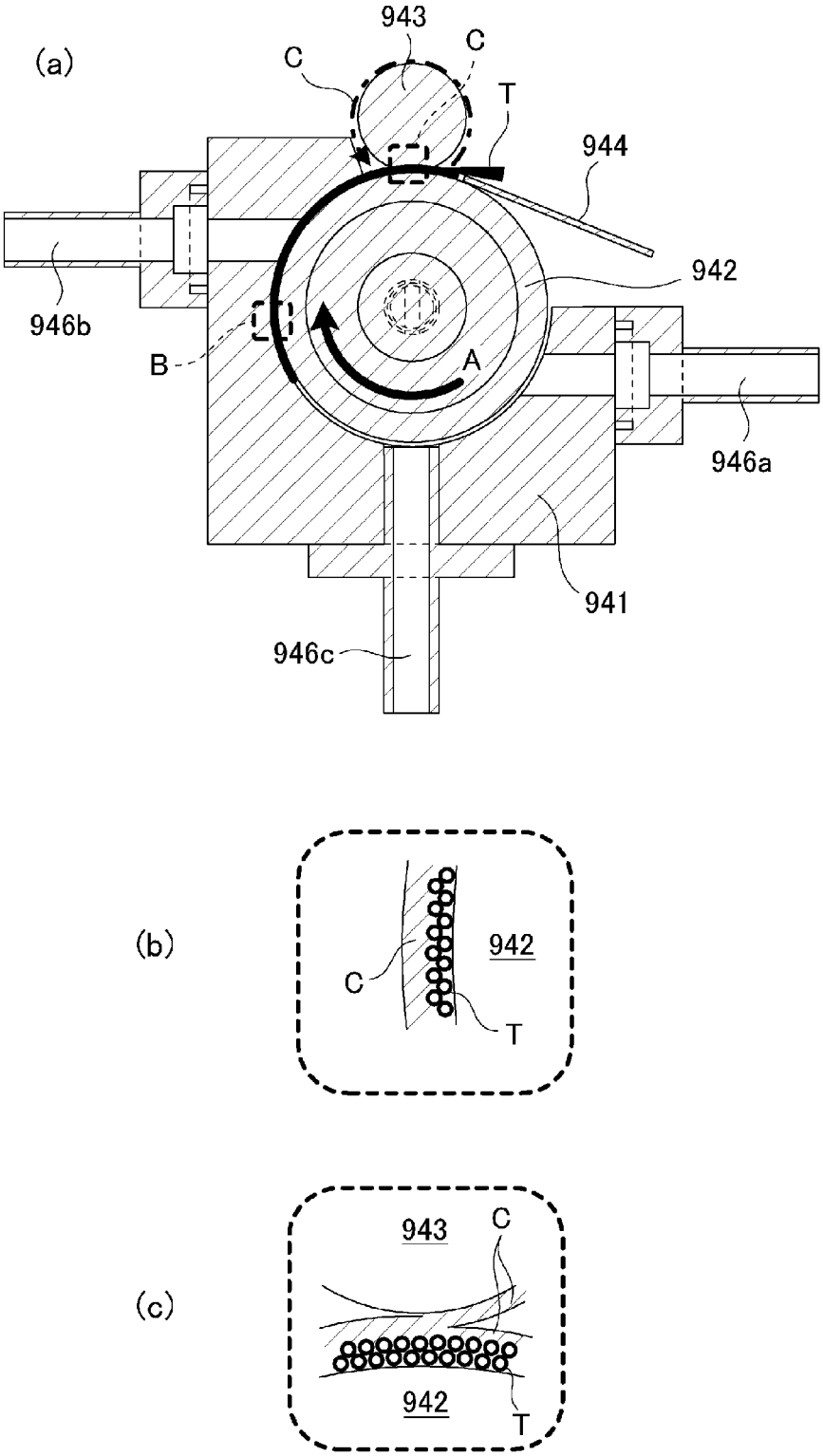
In FIG. 15, (a) is a sectional view of a separation and extraction device in a conventional example, and (b) and (c) are enlarged views of portion B and portion C, respectively, of (a) of FIG. 15, each showing a relation between a toner and a carrier liquid.

That is, as shown in FIG. 12, the toner T (solid line in FIG. 12) in the liquid developer passing through the gap 347 not only is electrically attracted to the electrode roller 342 but also receives an electrically repelling force from the coating electrode member 341. As a result, the toner T is electrically urged toward the electrode roller 342. At this time, similarly as in the above-described case shown in (b) of FIG. 15, the toner T layer is positioned on the electrode roller 342 side, and the carrier liquid C layer is positioned on the toner T layer. By the rotation of the electrode roller 342, the liquid including the toner T layer and the carrier liquid C layer is fed to a position opposing the collecting roller 351, and then the toner T layer is moved to the collecting roller 351 by the electric field.

The toner T which passed through the gap 347 and which was then fed to the collecting roller 351 by the electrode roller 342 not only is electrically attracted to the collecting roller 351 but also receives an electrically repelling force from the electrode roller 342. As a result, the toner is electrically urged in a direction of being spaced from the electrode roller 342, i.e., toward the collecting roller 351. At this time, the carrier liquid C is divided into a portion on the electrode roller 342 side and a portion on the collecting roller 351 side with a predetermined proportion, so that the divided carrier liquid C layer (chain line of FIG. 12) on the electrode roller 342 side is fed to the upstream end portion 347*a* of the gap 347 by the rotation of the electrode roller 342. That is, the divided carrier liquid C on the electrode roller 342 side between the electrode roller 342 and the collecting roller 351 is returned to the inlet. Then, the carrier liquid C merges with the liquid developer supplied from the supply tray 346*a* and is then fed again into the gap 347.

The toner electrically deposited on the collecting roller 351 is scraped off by the blade member 352. Here, the electromagnetic valve 47 is opened (S24). As a result, the toner scraped by the blade member 352 falls by its own weight and then is collected into the waste liquid collecting container 35 through the collecting portion 354. Incidentally, the toner may be disposed of or reused.

Further, the carrier liquid discharged to the discharge portion 346*b* through the downstream end portion 347*b* of the gap 347 is subjected to detection of the toner content by the carrier liquid content detecting device 34*a*, and whether or not the detected toner content is a predetermined value (e.g., 0.02%) or more is discriminated (S25). When the toner content is the predetermined value or less, the electromagnetic valve 45 is opened, so that the carrier liquid is sent to the carrier tank 32 (S26).

Then, when the separation and extraction of the carrier liquid from the separation and extraction device 34 is completed (S27), the electromagnetic valves 45 and 47 are closed (S28), and the voltage applying device 345 and the driving motor 205 are successively stopped (S29, S30).

Then, the residual developers in a predetermined amount are fed again into the separation and extraction device 34 by the pumps 48, 49, 50, and a subsequent separation process is performed. Thereafter, such an operation is repeated.

In the separation and extraction device 34 in this embodiment, from 100.0 cc of the liquid developer (containing 90.0 cc of the carrier liquid and 10.0 cc of the toner), 88.0 cc of the carrier liquid can be extracted. A required time in one separation process is 30 seconds, for example, and in this case, it is possible to meet a process speed up to 800 mm/s.

(Arrangement of Blade Member)

Figure 13:
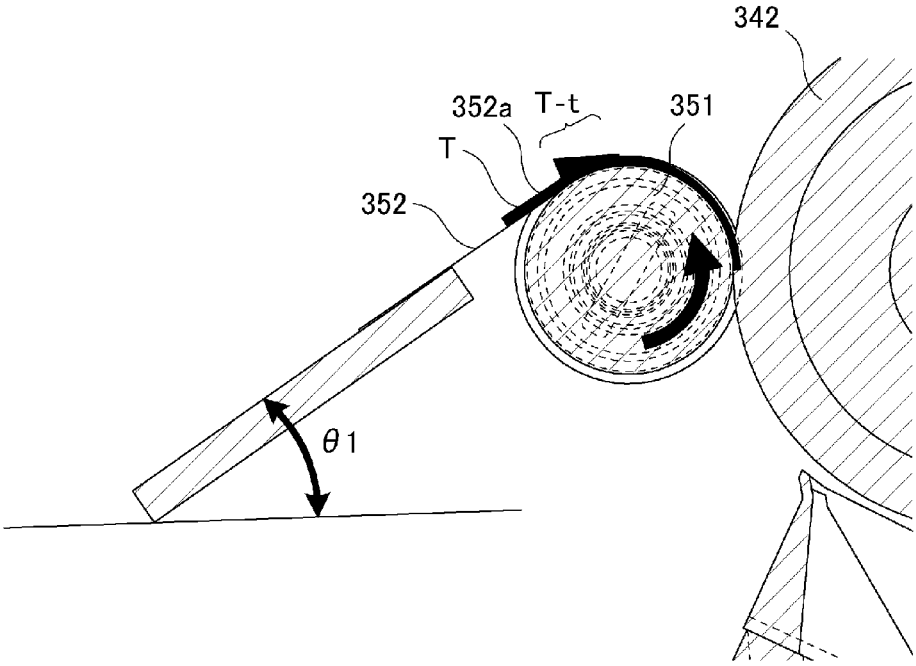
FIG. 13 is a sectional view showing another example of the separation and extraction device in the embodiment, in which a peripheral portion of a collecting roller is shown.

Arrangement of the blade member 352 will be described using FIGS. 12 to 14. As described above, the blade member 352 scrapes off the toner moved to the collecting roller 351. The blade member 352 is provided so that the blade member 352 extends in the counter direction against the collecting roller 351 and so that the blade member 352 contacts the collecting roller 351 along a tangential direction of the collecting roller 351. In the case where a free end portion 352*a*, of the blade member 352, contacting the collecting roller 351 is on an upper half surface (portion) of the collecting roller 351 with respect to the direction of gravitation, the blade member 352 is disposed in the following manner. That is, in order to move the toner T on the blade member 352 by gravitation, the blade member 352 is disposed so that the free end portion 352*a* thereof where the blade member 352 is supported is positioned on an upper side and a base end portion thereof is positioned on a lower side with respect to the direction of gravitation. In other words, the blade member 352 is disposed so that the free end portion 352*a* is positioned above the base end portion with respect to the direction of gravitation.

At this time, there is a possibility that the toner T layer stagnates on the blade member 352 depending on an angle at which the blade member 352 contacts the collecting roller 351. For example, as shown in FIG. 13, in the case where the blade member 352 is in such an attitude that an angle θ1 of the blade member 352 with respect to the horizontal direction is approximately 35° or less (θ1≤35°), the toner does not readily run on the blade member 352. Further, on the collecting roller 351 rotating in an arrow direction (counterclockwise direction) of FIG. 13, at a portion upstream of the free end portion 352*a* of the blade member 352, the toner T is liable to stagnate while forming an agglomeration T-t.

In order to suppress stagnation of the toner T as described above, when the free end portion 352*a* of the blade member 352 is on the upper(-half) surface of the collecting roller 351 with respect to the direction of gravitation, it is preferable that the blade member 352 is disposed so that the angle thereof with respect to the horizontal direction is larger than 35°. In other words, the attitude of the blade member 352 may preferably be disposed in a side closer to a vertical side, with respect to the direction of gravitation, than the angle of an approximately 35° with respect to the horizontal direction (i.e., θ1>35°).

Figure 14:
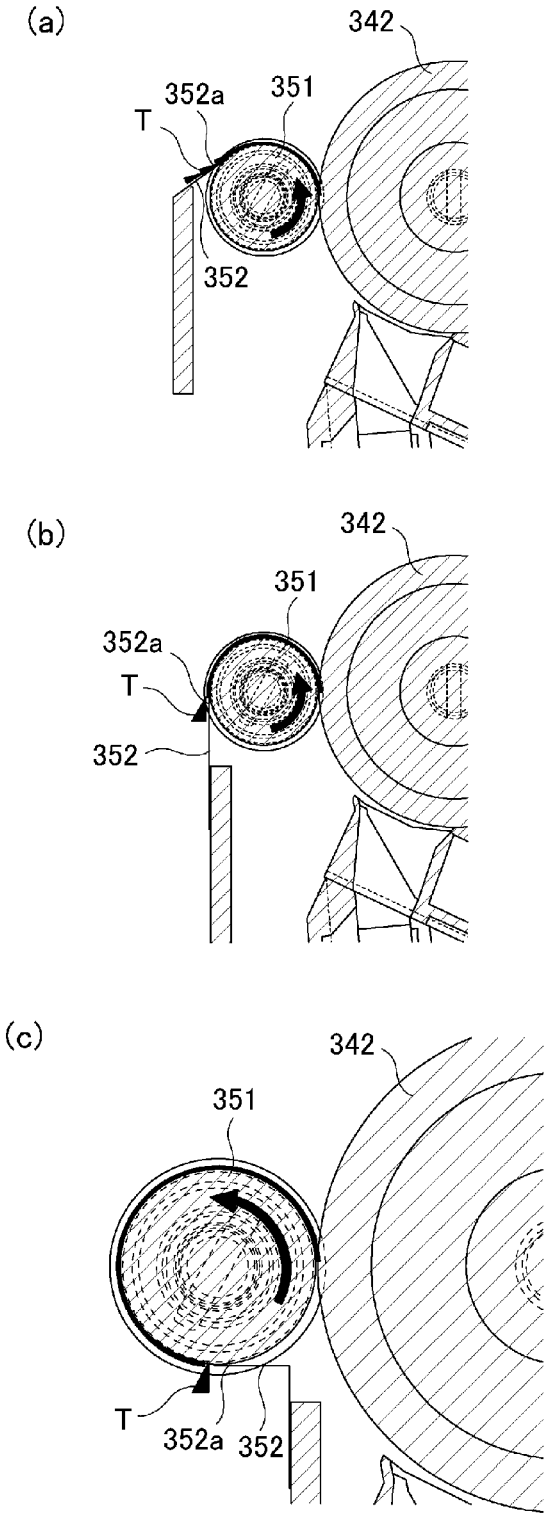
In FIG. 14, (a) to (c) are sectional views showing first to third examples, respectively, of the separation and extraction device in the embodiment, in which a peripheral portion of a collecting roller is shown in each of the first to third examples.

Here, in the case where a position of contact of the free end portion 352*a* of the blade member 352 with the collecting roller 351 is a position as shown in (a) of FIG. 14, the attitude of the blade member 352 is about 35° with respect to the horizontal direction. The position shown in (a) of FIG. 14 is, in the case where a line α1 (FIG. 12) passing through a center O1 and a top of the collecting roller 351 with respect to the direction of gravitation is 0°, such that the position of the free end portion 352*a* contacting the collecting roller 351 is a position of 35° along the rotational direction of the collecting roller 351. In other words, in the case where an angle formed between the line α1 and a line β1 passing through the contact position of the free end portion 352*a* with the collecting roller 351 and the center O1 is θ2 (FIG. 12), when θ2 is 35°, the attitude of the blade member 352 is about 35° with respect to the horizontal direction. Accordingly, the blade member 352 may preferably be disposed so that the position of the free end portion 352*a* contacting the collecting roller 351 is a position of 35° or more along the rotational direction of the collecting roller 351.

Further, as shown in (b) of FIG. 14, in the case where the position of the free end portion 352*a* contacting the collecting roller 51 is a position of 90° along the rotational direction of the collecting roller 351, the attitude of the blade member 352 is about 90° (vertical) with respect to the horizontal direction. Accordingly, in the case where the free end portion 352*a* of the blade member 352 is on the upper-half surface of the collecting roller 351 with respect to the direction of gravitation, the position of the free end portion 352*a* may preferably be a position of 35° or more and 90° or less along the rotational direction of the collecting roller 351. In this case, the blade member 352 is disposed so that the angle thereof with respect to the horizontal direction is larger than about 35°, and therefore it is possible to suppress that the toner T stagnates on the collecting roller 351 in the neighborhood of the free end portion 352*a* of the blade member 352. As a result, scraping-off of the toner by the blade member 352 can be satisfactorily effected.

On the other hand, as shown in (c) of FIG. 14, in the case where the free end portion 352*a*, of the blade member 352, contacting the collecting roller 351 is on the lower-half surface of the collecting roller 351 with respect to the direction of gravitation, the blade member 352 is disposed as follows. That is, in the case where the free end portion 352*a* contacts the collecting roller 351 at the lower-half portion of the collecting roller 351, the position of the free end portion 352*a* may be any position if the position of the free end portion 352*a* is in a range to the position of contact between the collecting roller 351 and the electrode roller 342. In this case, even at any position of the free end portion 352*a*, the toner T scraped by the blade member 352 falls downward by gravitation. Accordingly, when the free end portion 352*a* contacting the collecting roller 351 is positioned in a range from the position of the free end portion 352*a* being 90° or more along the rotational direction of the collecting roller 351 to the position of contact between the collecting roller 351 and the electrode roller 342, the toner scraping by the blade member 352 can be satisfactorily performed.

From the above, in order to satisfactorily perform the scraping of the toner T by the blade member 352, first, the blade member 352 is disposed along the counter direction against the collecting roller 351 and along the tangential direction of the collecting roller 351. Further, the free end portion 352*a* contacting the collecting roller 351 may preferably be positioned in a range from the position of 35° or more along the rotational direction of the collecting roller 351 to the position of contact between the collecting roller 351 and the electrode roller 342. In a further preferred example, the attitude of the blade member 352 is in a position of about 90° (vertical) with respect to the horizontal direction, i.e., in a position of the free end portion 352*a*, contacting the collecting roller 351, being about 90° along the rotational direction of the collecting roller 351.

Further, the collecting roller 351 is, in the case where the line α passing through the center O of the electrode roller 342 and the top of the electrode roller 342 with respect to the direction of gravitation is 0° (FIG. 7), positioned in a range of 180° (preferably 270°) or more and 360° or less along the rotational direction of the electrode roller 342.

(Toner Collecting Portion)

Next, the collecting portion 354 for collecting the toner scraped by the blade member 352 as described above will be described using FIG. 12. The collecting portion 354 includes the wall portion 354*a*, to which the base end portion of the blade member 352 is fixed, for guiding the toner, scraped by the blade member 352, downwardly with respect to the direction of gravitation. The wall portion 354*a* is, in the case where an angle of the blade member 352 with respect to the direction of gravitation is a predetermined angle, disposed with an angle which is the predetermined angle or less with respect to the direction of gravitation. For example, in the case where the blade member 352 inclines with an angle of 30° (predetermined angle) with respect to the direction of gravitation, the wall portion 354*a* is disposed with an angle of 30° or less (i.e., 0° to 30°) with respect to the direction of gravitation. In a preferred example, the wall portion 354*a* is disposed with an angle of substantially 0° (vertical) with respect to the direction of gravitation.

As a result, the toner which is scraped by the blade member 352 and which is moved along the surface of the blade member 352 is guided smoothly along the wall portion 3534*a*. That is, in the case where the wall portion 354*a* inclines with respect to the direction of gravitation in a degree larger than the blade member 352 inclines, there is a possibility that the toner moved along the surface of the blade member 352 stagnates at a connecting portion between the blade member 352 and the wall portion 354*a*. On the other hand, as in this embodiment, the wall portion 354*a* is caused to approach the vertical direction (direction of gravitation) more than the blade member 352 approaches, so that such a stagnation of the toner can be suppressed and thus the scraped toner can be smoothly collected. Incidentally, in order to suppress the toner stagnation, it is preferable that a toner guiding surface of the wall portion 354*a* approaches the vertical direction as the toner guiding surface extends from the toner scraping position by the blade member 352 toward the downstream side with respect to a toner collecting direction (circumferential direction), and in such a constitution, a constitution other than the above-described constitution may also be employed. For example, the wall portion 354*a* may also be curved so that the wall portion 354*a* gradually approaches the vertical direction from a downstream end portion with respect to the collecting direction of the toner by the blade member 352.

In the case of this embodiment as described above, a collection rate (ratio) of the carrier liquid can be enhanced. That is, as shown in FIG. 12, the toner T in the liquid developer supplied into the gap 347 between the electrode roller 342 and the coating electrode member 351 is first moved toward the electrode roller 342 side by the electric field. At this time, a part of the carrier liquid C is moved together with the toner T toward the electrode roller 342 side, and a remaining carrier liquid C is discharged to the discharge portion 346*b*.

The toner T and the part of the carrier liquid C which are moved to the electrode roller 342 are fed to the position opposing the collecting roller 351, and then the toner T layer is moved to the collecting roller 351 by the electric field. At this time, the carrier liquid C is divided into the portion on the electrode roller 342 side and the portion on the collecting roller 351 side with the predetermined proportion, and then the divided carrier liquid C on the electrode roller 342 side is fed to the upstream end portion 347*a* of the gap 347 by the rotation of the electrode roller 342. That is, the divided carrier liquid C on the electrode roller 342 side between the electrode roller 342 and the collecting roller 351 is returned to the inlet of the gap 347. Then, the carrier liquid C merges with the liquid developer supplied from the supply tray 346*a* and then passes through the gap 347 again. At this time, as described above, a part of the carrier liquid C is moved together with the toner T toward the electrode roller 342 side, and a remaining carrier liquid C is discharged to the discharge portion 346*b*.

Accordingly, in the case of this embodiment, the carrier liquid C fed to between the collecting roller 351 and the electrode roller 342 little increases in amount. That is, the carrier liquid fed to the position opposing the collecting roller 351 and then remaining on the electrode roller 342 side is fed again into the gap 347. For this reason, the amount of the carrier liquid C which passes through the gap 347 and which is then fed by the rotation of the electrode roller 346 to the position opposing the collecting roller 351 little increases. For this reason, it is also possible to suppress an increase in amount of the carrier liquid scraped together with the toner, so that the collection rate of the carrier liquid can be increased.

Further, the toner moved to the collecting roller 351 is scraped by the blade member 352, but the blade member 352 is disposed as described above, and therefore the toner scraping can be performed satisfactorily. Further, the angle of the wall portion 354*a*, with respect to the direction of gravitation, of the collecting portion 354 to which the base end portion of the blade member 352 is fixed is set as described above, and therefore collection of the scraped toner can be smoothly performed.

[Another Embodiment]

In the above-described embodiment, the example in which the toner is used as the dispersoid and the carrier liquid is used as the dispersion medium was described, but the present invention is applicable if the dispersoid and the dispersion medium are separable by the electric field. For example, a constitution in which the dispersoid is the charge control agent and the dispersion medium is the carrier liquid may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

According to the present invention, the separating property between the carrier liquid and the toner can be improved.

The invention claimed is:

1. A separating device for separating a toner and a carrier liquid from a liquid developer including the toner and the carrier liquid using an electric field, said separating device comprising:

an electroconductive electrode roller rotatable in a predetermined direction;

an electrode member provided with a gap between itself and an outer peripheral surface of said electrode roller, wherein said electrode member is capable of applying a voltage for generating an electric field for moving the toner toward said electrode roller between said electrode roller and said electrode member, wherein an upstream end portion of the gap with respect to a rotational direction of said electrode roller is provided above, with respect to a direction of gravitation, a downstream end portion of the gap with respect to the rotational direction;

a supplying portion configured to supply the liquid developer to said electrode roller;

a collecting portion provided below the downstream end portion of the gap with respect to the direction of gravitation and configured to collect the carrier liquid from said electrode roller in a side downstream of said electrode member with respect to the rotational direction;

a collecting roller provided downstream of said electrode member and upstream of said supplying portion with respect to the rotational direction and rotatable in the same peripheral movement direction as said electrode roller in contact with said electrode roller at a position opposing said electrode roller, wherein said collecting roller is capable of applying a voltage for generating an electric field for moving the toner toward said collecting roller between said collecting roller and said electrode roller; and a blade member configured to collect the toner from said collecting roller and in contact with said collecting roller counterdirectionally with respect to a rotational direction of said collecting roller, wherein when a line passing through a center of said electrode roller and a top of said electrode roller with respect to the direction of gravitation is 0°, the upstream end portion of the gap is positioned in a range of 0° or more and less than 180° with respect to the rotational direction of said electrode roller, and wherein when a line passing through a center of said collecting roller and a top of said collecting roller with respect to the direction of gravitation is 0°, a contact position of said blade member with said collecting roller is in a range of 35° or more in a side upstream of a position of contact between said collecting roller and said electrode roller with respect to the rotational direction of said collecting roller.

2. A separating device according to claim 1, wherein said collecting roller is positioned in a range of 180° or more and less than 360°.

3. A separating device according to claim 1, wherein said blade member is provided so as to have an angle of more than 35° with respect to a horizontal direction.

4. A separating device according to claim 1, wherein the downstream end portion of the gap is positioned in a range of 0° or more and 180° or less with respect to the rotational direction of said electrode roller.

5. A separating device according to claim 1, wherein a free end portion of said blade member is positioned above a base end portion of said blade member with respect to the direction of gravitation.

6. A separating device according to claim 1, further comprising a toner collecting portion configured to collect the toner scraped by said blade member, wherein said toner collecting portion includes a wall portion configured to guide the toner scraped by said blade member downwardly with respect to the direction of gravitation, wherein a base end portion of said blade member is fixed to said wall portion and when an angle of said blade member with respect to the direction of gravitation is a predetermined angle, said wall portion is provided with an angle not more than the predetermined angle.

7. A separating device according to claim 1, wherein the upstream end portion of the gap is positioned in a range of 60° or more and less than 120° with respect to the rotational direction of said electrode roller.

8. A separating device according to claim 1, wherein the contact position of said blade member with said collecting roller is in a range of 35° or more and less than 90° with respect to the rotational direction of said collecting roller.

9. A separating device for separating a toner and a carrier liquid from a liquid developer including the toner and the carrier liquid using an electric field, said separating device comprising:

an electroconductive electrode roller rotatable in a predetermined direction;

an electrode member provided with a gap between itself and an outer peripheral surface of said electrode roller, wherein said electrode member is capable of applying a voltage for generating an electric field for moving the toner toward said electrode roller between said electrode roller and said electrode member, a supplying portion configured to supply the liquid developer to said electrode roller;

a collecting portion provided below a downstream end portion of the gap with respect to the direction of gravitation and configured to collect the carrier liquid from said electrode roller in a side downstream of said electrode member with respect to the rotational direction;

a collecting roller provided downstream of said electrode member and upstream of said supplying portion with respect to the rotational direction and in contact with said electrode roller, wherein said collecting roller is capable of applying a voltage for generating an electric field for moving the toner toward said collecting roller between said collecting roller and said electrode roller;

a blade member configured to remove the toner from said collecting roller and in contact with said collecting roller counterdirectionally with respect to a rotational direction of said collecting roller;

a supporting portion configured to support said blade member;

wherein a contact portion between said blade member and said collecting roller is positioned above, with respect to the direction of gravitation, a portion where said supporting portion supports said blade member, and a toner accommodating portion configured to accommodate the toner removed by said blade member.

10. A separating device according to claim 9, wherein said electrode roller includes an elastic layer.

11. A separating device according to claim 9, wherein said collecting roller is a metal roller.

12. A separating device according to claim 9, wherein said blade member forms an angle of 35° or more with respect to a horizontal surface.

13. A image forming apparatus comprising:

an image bearing member;

an image forming portion configured to form a toner image on said image bearing member with a liquid developer including toner and a carrier liquid;

a transfer portion configured to transfer the toner image from said image bearing member onto a toner image receiving material;

a cleaning portion configured to remove the liquid developer from said image bearing member after transfer of the toner image;

a separating device for separating a toner and a carrier liquid from the liquid developer supplied from said cleaning portion, said separating device comprising, an electroconductive electrode roller rotatable in a predetermined direction;

an electrode member provided with a gap between itself and an outer peripheral surface of said electrode roller, wherein said electrode member is capable of applying a voltage for generating an electric field for moving the toner toward said electrode roller between said electrode roller and said electrode member, a supplying portion configured to supply the liquid developer to said electrode roller;

a collecting portion provided below a downstream end portion of the gap with respect to the direction of gravitation and configured to collect the carrier liquid from said electrode roller in a side downstream of said electrode member with respect to the rotational direction;

a collecting roller provided downstream of said electrode member and upstream of said supplying portion with respect to the rotational direction and in contact with said electrode roller, wherein said collecting roller is capable of applying a voltage for generating an electric field for moving the toner toward said collecting roller between said collecting roller and said electrode roller;

a blade member configured to remove the toner from said collecting roller and in contact with said collecting roller counterdirectionally with respect to a rotational direction of said collecting roller;

a supporting portion configured to support said blade member;

wherein a contact portion between said blade member and said collecting roller is positioned above, with respect to the direction of gravitation, a portion where said supporting portion supports said blade member, and a toner accommodating portion configured to accommodate the toner removed by said blade member.

14. A separating device according to claim 13, wherein said electrode roller includes an elastic layer.

15. A separating device according to claim 13, wherein said collecting roller is a metal roller.

16. A separating device according to claim 13, wherein said blade member forms an angle of 35° or more with respect to a horizontal surface.

17. A separating device for separating a toner and a carrier liquid from a liquid developer including the toner and the carrier liquid using an electric field, said separating device comprising:

an electroconductive electrode roller rotatable in a predetermined direction;

an electrode member provided with a gap between itself and an outer peripheral surface of said electrode roller, wherein said electrode member is capable of applying a voltage for generating an electric field for moving the toner toward said electrode roller between said electrode roller and said electrode member, a supplying portion configured to supply the liquid developer to the electrode roller;

a collecting portion provided below the downstream end portion of the gap with respect to the direction of gravitation and configured to collect the carrier liquid from said electrode roller in a side downstream of said electrode member with respect to the rotational direction;

a collecting roller provided downstream of said electrode member and upstream of said supplying portion with respect to the rotational direction in contact with said electrode roller, wherein said collecting roller is capable of applying a voltage for generating an electric field for moving the toner toward said collecting roller between said collecting roller and said electrode roller; and a blade member configured to remove the toner from said collecting roller in contact with said collecting roller counterdirectionally with respect to a rotational direction of said collecting roller.

18. A separating device according to claim 17, wherein said electrode roller includes an elastic layer.

19. A separating device according to claim 17, wherein said collecting roller is a metal roller.

20. A separating device according to claim 17, wherein said blade member forms an angle of 35° or more with respect to a horizontal surface.

21. A separating device according to claim 17, wherein said blade member is a metal blade.

* * * * *